US011578858B2

(12) United States Patent
Elmvang et al.

(10) Patent No.: US 11,578,858 B2
(45) Date of Patent: Feb. 14, 2023

(54) MODULAR LIGHTING DEVICE

(71) Applicant: Fischer Lighting Holding ApS, Vanløse (DK)

(72) Inventors: Stig Elmvang, Skovlunde (DK); Lasse Lind, Copenhagen K (DK); Enlai Hooi, Copenhagen K (DK)

(73) Assignee: Fischer Lighting Holding APS

( * ) Notice: Subject to any disclaimer, the term of this patent is extended or adjusted under 35 U.S.C. 154(b) by 0 days.

(21) Appl. No.: 17/277,508

(22) PCT Filed: Sep. 23, 2019

(86) PCT No.: PCT/EP2019/075532
§ 371 (c)(1),
(2) Date: Mar. 18, 2021

(87) PCT Pub. No.: WO2020/058528
PCT Pub. Date: Mar. 26, 2020

(65) Prior Publication Data

US 2022/0026057 A1 Jan. 27, 2022

(30) Foreign Application Priority Data

Sep. 21, 2018 (EP) ..... 18195941

(51) Int. Cl.
*F21V 17/12* (2006.01)
*F21S 8/06* (2006.01)
(Continued)

(52) U.S. Cl.
CPC ..... *F21V 17/12* (2013.01); *F21S 8/02* (2013.01); *F21S 8/061* (2013.01); *F21V 7/04* (2013.01); *F21V 7/10* (2013.01); *F21V 15/01* (2013.01); *F21V 17/002* (2013.01); *F21V 17/06* (2013.01); *F21V 21/104* (2013.01);
(Continued)

(58) Field of Classification Search
CPC ..... F21V 17/12; F21V 7/04; F21S 8/02
See application file for complete search history.

(56) References Cited

U.S. PATENT DOCUMENTS 5,363,295 A 11/1994 DeKleine et al.
5,673,997 A 10/1997 Akiyama
(Continued)

FOREIGN PATENT DOCUMENTS

DE 196 08 583 A1 9/1996
EP 0 909 919 A2 4/1999
(Continued)

*Primary Examiner* — Leah Simone Macchiarolo
(74) *Attorney, Agent, or Firm* — Dinsmore & Shohl LLP

(57) ABSTRACT

The present invention relates to lighting fixtures which are mounted into architectural finished surfaces such as ceilings, walls and floors, and is applicable to new installations as well as the renovation of existing surface-mounted fixtures. One embodiment relates to a modular lighting device for retro-fitting to an existing lamp housing which is flush mounted or countersunk into an opening of a ceiling or interior surface of a building, the modular lighting device comprising a lamp-fitting configured for receiving a light
(Continued)

source and configured for attachment to the existing lamp housing, and reflector for reflecting and/or modifying light from the light source, the reflector comprising a narrow top section configured for attachment to said lamp-fitting, and a wider bottom section for covering said opening.

19 Claims, 19 Drawing Sheets

(51) Int. Cl.

| | |
|---|---|
| ***F21V 7/10*** | (2006.01) |
| ***F21V 15/01*** | (2006.01) |
| ***F21V 21/104*** | (2006.01) |
| ***G10K 11/162*** | (2006.01) |
| ***F21S 8/02*** | (2006.01) |
| ***F21V 7/04*** | (2006.01) |
| ***F21V 33/00*** | (2006.01) |
| ***F21V 17/06*** | (2006.01) |
| ***F21V 17/00*** | (2006.01) |
| *F21Y 115/10* | (2016.01) |

(52) U.S. Cl.
CPC ..... *F21V 33/0056* (2013.01); *G10K 11/162* (2013.01); *F21Y 2115/10* (2016.08)

(56) References Cited

U.S. PATENT DOCUMENTS

| | | | |
|---|---|---|---|
| 10,779,478 | B2 | 9/2020 | Golle et al. |
| 2005/0168986 | A1 | 8/2005 | Wegner |
| 2010/0110674 | A1 | 5/2010 | Hysky |
| 2013/0201690 | A1 | 8/2013 | Vissenberg et al. |
| 2015/0109765 | A1 | 4/2015 | Sepkhanov et al. |
| 2017/0044761 | A1 | 2/2017 | Flotre et al. |
| 2017/0248290 | A1 | 8/2017 | Uhler |
| 2018/0336875 | A1 | 11/2018 | Patterson et al. |
| 2019/0088241 | A1 | 3/2019 | Czech et al. |
| 2019/0295519 | A1 | 9/2019 | Krass et al. |

FOREIGN PATENT DOCUMENTS

| | | | |
|---|---|---|---|
| EP | 3 242 071 | B1 | 11/2019 |
| GB | 2 313 184 | A | 11/1997 |
| GB | 2 326 467 | A | 12/1998 |
| WO | 98/12472 | A1 | 3/1998 |
| WO | 2014/053145 | A1 | 4/2014 |

(a)

(b)

(c)

Milling
(a)

Upholstery
(b)

Moulded
(c)

Stacked
(d)

MODULAR LIGHTING DEVICE

CROSS REFERENCE TO RELATED APPLICATIONS

This application is the U.S. national stage of PCT/EP2019/075532 filed Sep. 23, 2019, which claims priority of European patent application 18195941.2 filed Sep. 21, 2018, both of which are hereby incorporated by reference in their entirety.

FIELD OF THE INVENTION

The present invention relates to lighting fixtures which are mounted into architectural finished surfaces such as ceilings, walls and floors, and is applicable to new installations as well as the renovation of existing surface-mounted fixtures.

BACKGROUND OF INVENTION

Existing lighting fixtures installed in ceilings or other planar surfaces of buildings are often replaced for the purpose of upgrading the lighting system used for improved efficacy and quality of light, or during renovation. For lamps recessed or integrated into building surfaces, it is often difficult to install new lamps in the same place as the original lamps were located without damaging the surface on which the existing light fixture is mounted. Retrofitting new lighting devices often requires remediation or replacement of the finished surface on which they are installed for the new lighting fixtures to be properly installed in the building. Such additional work requires extra time and materials and is therefore more expensive than retrofitting new light sources into their existing housings. The presently disclosed modular lighting device provides a solution for the easy refitting of a new lighting device in place of an existing lighting fixture without the need for demounting the existing lamp housing, thereby avoiding the need for additional work on the building surfaces or structure.

When installing new light fixtures in place of existing light fixtures, it is favourable that neither the lamp-housing (the casing for the existing lamp which is mounted or recessed into a building surface) nor the aperture from such devices are visible after the new light fixture is fitted to the building.

Installing new light fixtures usually entails removing the light fixture intended to be replaced, including the lamp-housing, repairing or replacing the building surface that the light fixture was attached to, and installing an entirely new lighting fixture in its place. This may be troublesome, as lamp-housings vary in size and additional surface remediation may be required to fit the new lamp. In some cases it is even necessary to replace the ceiling or refurbish the entire ceiling in order to fit new lamps. This adds a significant cost to the process of upgrading a building's lighting system. Furthermore, discarding the previous lamp housings is neither an economical or environmentally sustainable method of restoration. Therefore, there is a need for a solution whereby old recessed or surface-mounted light fixtures may be replaced with new light fixtures in a way that cost-efficient, easy to mount, environmentally friendly and aesthetically pleasing.

SUMMARY OF INVENTION

The presently disclosed modular lighting device offers a solution whereby existing lamp-housings of varying dimensions may remain in place whilst the light source and aesthetic component of the lighting system is exchanged, allowing the building surface that hosts the existing light fixtures to remain unmodified.

Alternatively, the presently disclosed modular lighting device may also be implemented as a new fitting, without a pre-existing light fitting to replace, or where the proceeding surface mounted or recessed light fixture is removed, necessitating a hole to be made for the installation of the presently disclosed modular lighting device.

A first embodiment of the present disclosure relates to a modular lighting device for retro-fitting to an existing lamp housing which is flush mounted or countersunk into an opening of a ceiling or interior surface of a building. The modular lighting device comprises a lamp-fitting and a reflector. The lamp-fitting is preferably configured for receiving a light source for the lighting device. The lamp-fitting may further be configured for attachment to the existing lamp housing. The reflector is provided for reflecting and/or modifying light from the light source. But equally important the reflector is provided to cover the lamp housing and thereby also the opening of the ceiling or the interior surface. The reflector may comprise a narrow top section configured for attachment the said lamp-fitting, and a wider bottom section for covering said opening.

The presently disclosed modular lighting device will henceforth be described in its capacity for being retrofit into an existing lamp installation in the ceiling or other planar surface of a building. This means that the modular lighting device may also be used for lamps located in e.g. walls or floors or other substantially planar surfaces, and may also be used for retrofitting lamps located at exterior parts of a building such as outer walls or overhang of ceilings. The process of installing a new lamp in place of an existing lamp may, throughout the present disclosure, be referred to as refitting or retrofitting.

The present disclosure also relates to lamp device comprising a lamp housing comprising a top section having an aperture and a bottom section defining an opening, a lamp-fitting configured for receiving a light source and configured for attachment to the top section of the lamp housing through the aperture, and a reflector for reflecting and/or modifying light from the light source, the reflector comprising a narrow top section configured for attachment to said lamp-fitting, and a wider bottom section configured for covering the opening of the lamp housing. I.e. the presently disclosed lamp device can be seen as the modular lighting device disclosed herein and a lamp housing, which can be an existing/old lamp housing, e.g. which is part of an existing installation in an opening in a building surface, such as a ceiling or wall/interior surface.

A lamp-fitting (exemplified in FIG. 1) is configured to house a light source and is configured for being secured to an existing typical lamp housing of the form which is recessed/countersunk into an opening of building surface, such as a ceiling or a wall surface/interior surface, such that a bottom perimeter of the lamp housing typically is flush with a ceiling or planar finished surface of a building. The lamp-fitting of the present disclosure may be understood as a fitting to house a light source, e.g. a lamp, light globe, LED or other light emitting device, and which is configured for attachment to an existing lamp-housing by use of mechanical fixation. The lamp-fitting may have a bezel and may be provided with an thread on at least a part, or the whole, of the outside surface. This thread may be used for engaging the reflector, typically toward a bottom section of the lamp-fitting. The thread may also be used when attaching to the lamp-housing, e.g. by means of nuts, typically toward the top section of the lamp-fitting. One purpose of the lamp-fitting is to provide a place to locate the light source for the lamp with respect to the existing lamp housing and another purpose is to connect the reflector to the lamp housing. An example of a lamp-fitting is disclosed in WO 2014/053145 by the same applicant, which is hereby enclosed by reference in its entirety. In the WO 2014/053145 the presently disclosed lamp-fitting is exemplified as "main body".

The purposes of the reflector are to reflect and/or modify light from the recessed light source housed in the lamp-fitting, and to span between the recessed lamp-fitting and the building surface, i.e. covering the opening in the building surface, such that the existing lamp housing is obscured from view. The reflector may also host additional technical or aesthetic features that may attach to it. Hence, the reflector is preferably configured such that the wide bottom section overlaps the perimeter of the existing lamp-housing which may slightly protrude below the ceiling surface. At the perimeter of the bottom section of the reflector it may fold back toward the ceiling, e.g. by means of a rim, so as to avoid potential collision with the lamp-housing. The presently disclosed reflector can be configured to fit a variety of lamp housing and aperture sizes therein due to the specifics of the form having a top narrow portion that extends into the finished ceiling surface when attached to the lamp-fitting, thereby inhabiting the interior of the lamp-housing as exemplified in FIG. 6. The bottom wider section of the reflector overlaps the finished building surface and lamp-housing. Reflectors used in prior art lighting devices are normally in a concave shape, which are, in practical terms, incapable of adapting to a variety of aperture sizes and depths. The use of a concave reflector in the prior art retrofitting of lighting devices in existing lamp-housings precludes its use in housings of different geometries. The reflector of the present disclosure may have a convex surface, possibly with negative surface curvature, which allows the presently disclosed modular lighting device to adapt a wide range of existing lamp-housings and aperture sizes.

The present disclosure therefore also relates to a method for retro-fitting a modular lighting device in a lamp housing of an existing lamp installation which is countersunk in and/or suspended behind an opening in a building surface, the method comprising the steps of:

- dismantling the lamp housing from the lamp installation,
- providing the presently disclosed modular lighting device,
- optionally creating an aperture in a top section of the lamp housing that is configured to match the lamp-fitting of the modular lighting device,
- securing the lamp-fitting to the top section of the lamp housing,
- optionally installing a light source in the lamp-fitting,
- attaching the reflector of the modular lighting device to the lamp-fitting, and
- installing the lamp housing with the modular lighting device in the opening of the building surface such that the reflector covers the opening and/or such that the lamp housing is obscured from view by the reflector.

DETAILED DESCRIPTION OF THE INVENTION

The presently disclosed devices are intended for, but not exclusive to, retrofitting a new lighting device into an existing installation in a building. This means that one or more parts of the existing installation may be used when refitting the new lighting device.

In one embodiment, the presently disclosed modular lighting device is installed in an existing lamp housing, e.g. from a dismantled lamp already mounted in the building, such that the lamp housing can be reused for installing the modular lighting device. The lamp-housing may be modified by creating a hole or aperture suitable to accommodate the lamp-fitting, such that the light-source that it houses is suspended behind the ceiling or building surface face, but at the centroid of the lamp housing aperture when viewed normal to the surface face. In this manner, the lamp-fitting may be attached to the housing e.g. by making a hole in the top part of the housing (FIG. 2) and attaching the lamp-fitting to the housing through the hole, cf. FIG. 3. This may be achieved by having a threaded exterior of the lamp-fitting and having nuts or some other parts engage with the lamp-fitting to secure it to the housing. The lamp-fitting may alternatively be secured to the lamp housing by glue or some other attachment method.

The presently disclosed recessed reflector (exemplified in FIG. 4) is attached either mechanically or by other means to the lamp-fitting, for example to a central bezel of the lamp-fitting, on the side of the lamp-fitting that holds the light-source in the lamp-fitting (exemplified in FIGS. 4, 6, 7, and 9). The recessed reflector is typically oriented with its open side facing away from the body of the lamp-fitting such that it can be used to reflect and/or scatter light emitted from the light source into the space beyond the ceiling or building surface into which it is mounted.

The reflector may be attached to the lamp-fitting, e.g. a bezel thereof, using mechanical fixation, for example by means of nut which is encapsulated by the surface material of the reflector, and which corresponds to a thread of the bezel of the lamp-fitting, thereby allowing fixation of the reflector to the lamp-fitting by means of a screwing-action or rotation. The fixation method between the lamp-fitting and the reflector is not limited to this method and may otherwise be achieved using adhesion, friction, magnetic attraction, interference, spring-form or other mechanical means. Furthermore, the mechanical fixation device represented here as an encapsulated nut may also be embodied in the material of the reflector.

Figure 8:
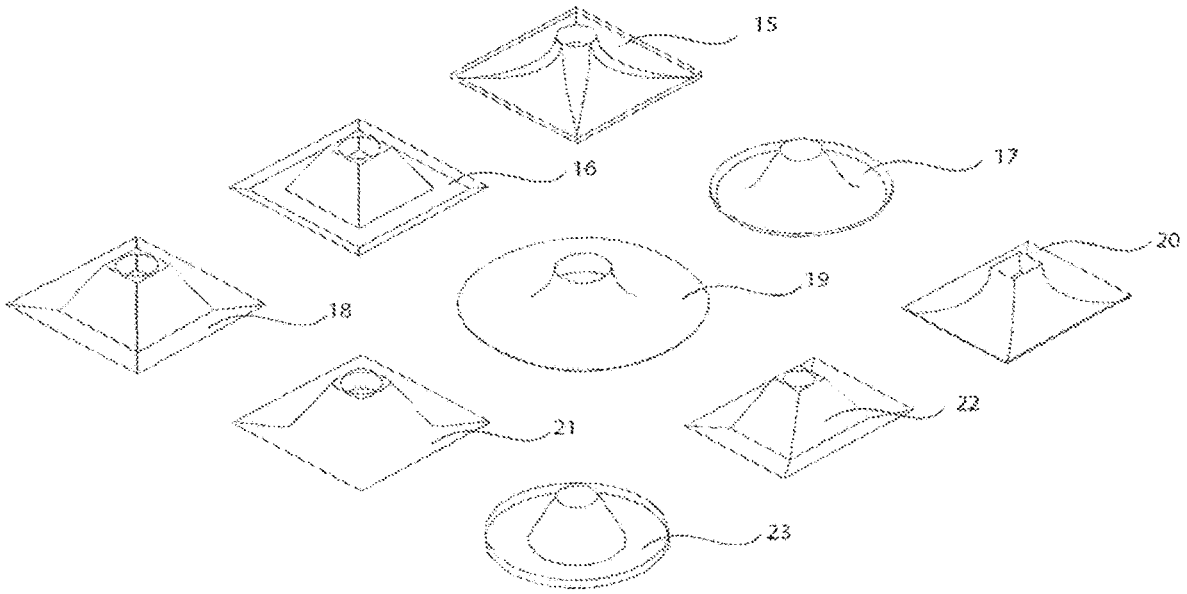
FIG. 8 shows various alternative topological configurations of reflectors.

The reflector may be in any shape such that the narrow top section of the reflector is smaller in overall girth than the bottom perimeter of the reflector such as 1) to allow the narrow top section to adapt to apertures in the lamp housing of greater variance than 20 mm, and 2) which serve to overlap the bottom perimeter of the existing lamp housings, as it is common that such lamp housings overlap the ceiling or building surface at their bottom perimeter. The reflector is thereby capable of adapting to the range of opening sizes in building surfaces which lie between the girth of the top section of the reflector and the bottom perimeter of the reflector. Exemplary alternative shapes of the reflector are shown in FIG. 8 and may include rectilinear forms that may suit square or rectangular openings in building surfaces and apertures in lamp housings.

The reflector is preferably in the shape of a convex curve and preferably such that the bottom section of the reflector is substantially parallel with the building surface in which the device is installed and thereby can cover the existing lamp installation. I.e. the reflector may be in any shape comprising or resembling a convex curve. In one embodiment of the invention at least part of the shape of the reflector is an exponential curve, or a hyperbola, or part of a parabola or another polynomial, or part of a circle such as a quarter of a circle, or part of an ellipse such as a quarter of an ellipse. Other functions that may be used to describe the shape of the reflector include a rational function, a root function such as square root or cube root, a logarithm from any base such as 2 or the mathematical constant e or 10, or part of any of these functions. In some embodiments the shape of the reflector may also be a combination of two or more of the previously mentioned functions. Hence, the majority of the surface of presently disclosed reflector preferably exhibits negative-surface-curvature, with a convex section line as exemplified in the drawings. This is to seamlessly span between the lamp-fitting and the building surface, whereby the surface direction of the reflector closest to the lamp-fitting is substantially parallel to the outside surface of the lamp-fitting, while toward the bottom perimeter of the reflector, the surface direction of the reflector is substantially parallel to the building surface into which it is mounted.

Figure 9:
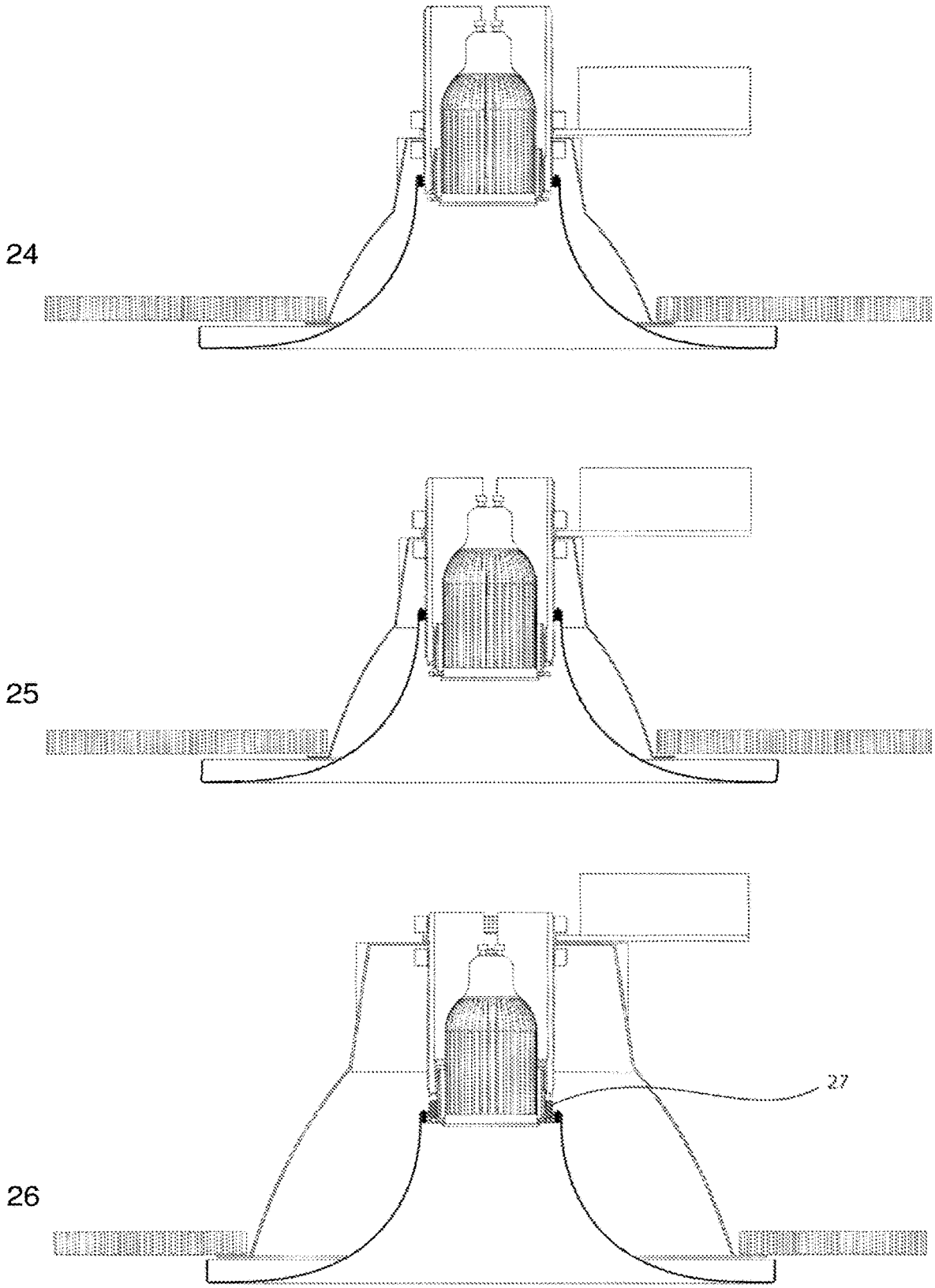
FIG. 9 shows, in cross-sectional side-view, three different configurations of the presently disclosed modular lighting device and the corresponding lamp housing.

When engaging the presently disclosed modular lighting device with lamp-housings of differing depths, the position of the lamp-fitting may be adjusted with respect to the lamp-housing such that the bottom perimeter of the reflector substantially matches the opening of the building surface such that the lamp housing and opening is covered by the reflector, as illustrated in FIG. 9 showing lamp housings of different heights and the corresponding adjustment of the lamp-fitting and reflector therein.

In the case that there is insufficient length in the lamp-fitting to allow the reflector to both engage with the lamp fitting and span the opening in the building surface, one or more adaptive elements are may be provided in conjunction with one another or separately as required. The effective length of the bezel thread may be increased by adding an element, e.g. a double-threaded nut as shown in FIG. 9, which is configured such that the inner thread of the nut mechanically attaches to the outer thread of the collar that is used to secure the light source. The outer thread of the nut matches the outer thread of the bezel. This double-threaded nut may be secured first to the collar, and the remainder of the collar thread is then attached to the inner thread of the lamp-fitting bezel. In this way, it is possible to extend the effective length of the lamp-fitting bezel. Further extension is possible, e.g. if the collar is elongated by way of increasing the thread length thereby producing modified collar. Utilizing this element in combination with the double-threaded nut, permits a larger range of lamp-housing depths to be retrofitted.

The type of light source may be a light-emitting diode (LED), or an incandescent bulb, or halogen bulb, or a fluorescent light bulb such as s compact fluorescent light bulb (CFL). The light source could also be two or more of the types mentioned or any combination thereof. The light source is preferably located near the top section of the reflector in order to better illuminate the surroundings but alternatively, may be located in a reflector attachment element.

The modular lighting device may be fabricated from different materials. In one embodiment the reflector is fabricated from steel, or aluminium, e.g. brushed aluminum, or polished aluminum, or plastic. The lamp-fitting may be fabricated from the same or similar materials. Furthermore, in another embodiment the reflector may be coated with another material such as paint. In yet another embodiment the reflector is plated with a metal such as gold, silver, copper, chrome, zinc, tin or nickel. This may be used to give the recessed reflector the right characteristics for distributing and modifying the light from the lighting device.

Figure 10:
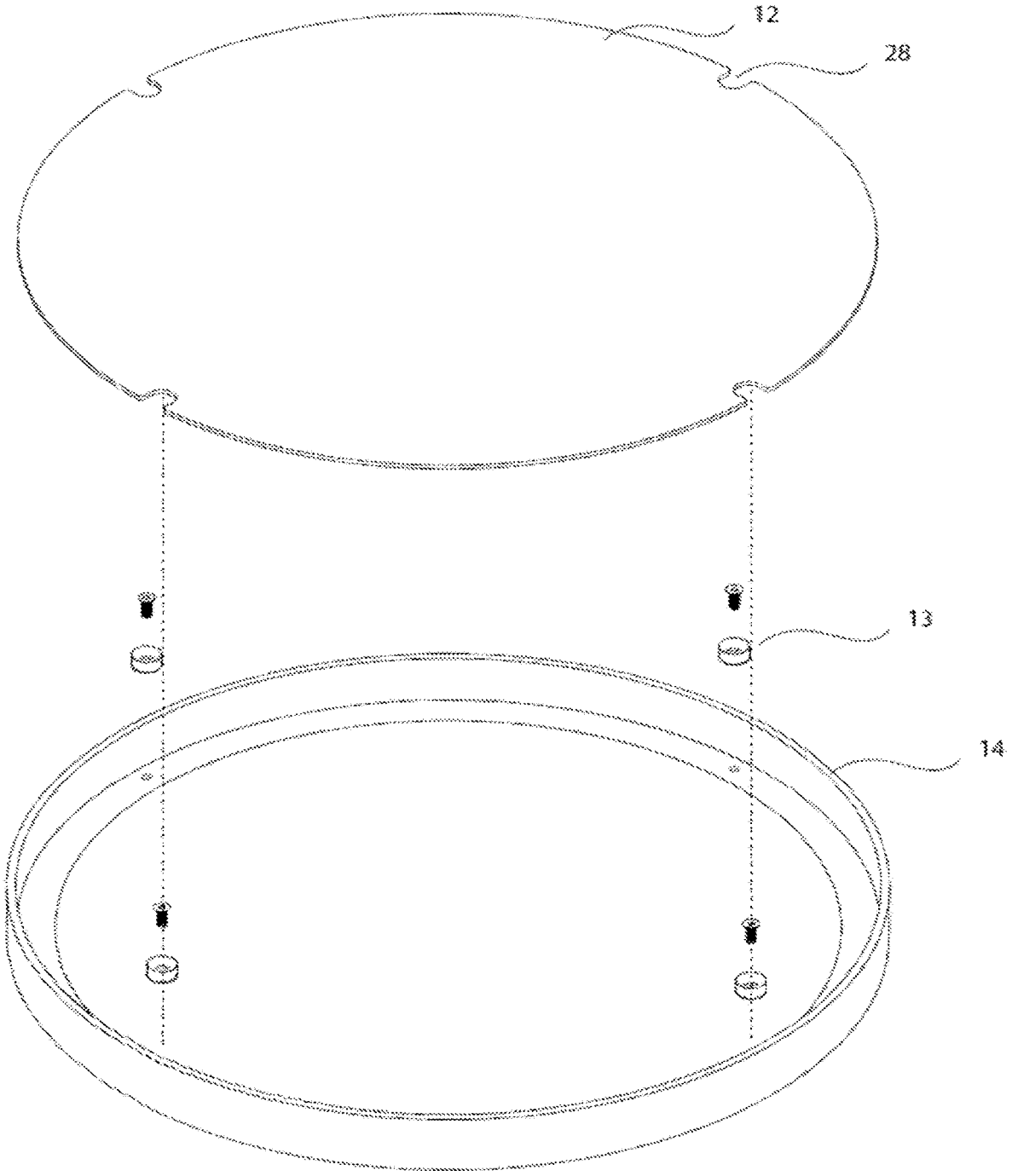
FIG. 10 shows an exploded view of one embodiment of a light modifier whereby a diffusor or lens is held in place by a holding-ring.
Figure 11:
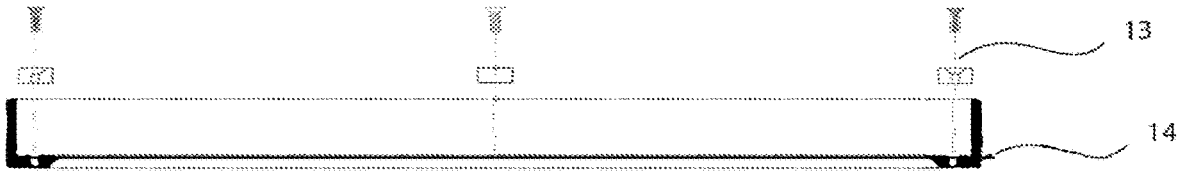
FIG. 11 shows a cross-sectional side view of one embodiment of a light modifier whereby a diffusor or lens is held in place by a holding-ring.
Figure 12:
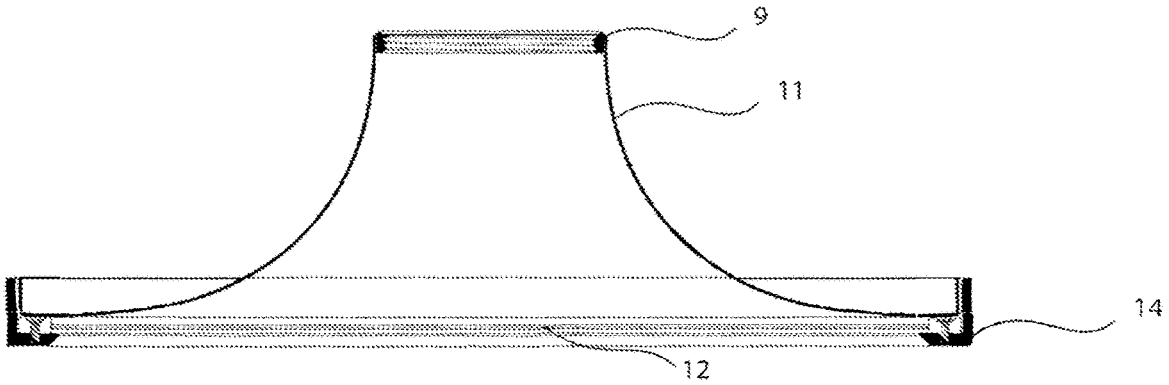
FIG. 12 shows a cross-sectional side view of one embodiment of a light modifier whereby a diffusor or lens is held in place by a holding-ring and a corresponding reflector.

In addition to being retrofitted in an existing installation, the presently disclosed devices should also preferably provide a pleasant and comfortable light in the surrounding area. In some situations it may be preferred that the light is soft and not glaring or very direct. This may be provided by one or more attachments to the presently disclosed devices where said attachments further comprise a light-modifier for distributing, diffusing or refracting the light from the light source. The light-modifier may be attached at a preselected distance below the reflector. In one embodiment the light-modifier comprises a holding-ring which has the capacity to encapsulate a lens or diffuser. The diffuser may be made from a translucent or transparent resilient material and is held by the holding-ring (exemplified in FIGS. 10-12), which has the purpose of diffusing or modifying the light that passes through it. The holding-ring may be round, as shown in FIG. 10, but it can also be any shape that suits the corresponding reflector. The diffuser may be flat or curved or rounded, such as part of a sphere with a certain diameter. One embodiment of the light-modifier is shown in FIGS. 10-12 and shows a holding-ring configured for attachment to the perimeter of the reflector by magnetic force, whereby magnetic elements are secured mechanically using recessed screws, and the diffuser is located within the holding-ring by means of the magnets. The magnetic force thereby secures the diffusor between the holding ring and the reflector. The holding ring may alternatively be attached to the reflector using other methods such as friction, pressure, adhesion or mechanical attachment.

In an alternative embodiment, the light-modifier is attached directly to the lamp-fitting, fixed either to the aforementioned collar or to the bezel of the lamp-fitting. In such a case that the light-modifier is attached to the lamp-fitting and depending on the purpose and size of the light-modifier, it may either be made from transparent or translucent material or furthermore be made from opaque material metal, such as brushed aluminum or polished aluminum, or plastic. In such cases, the purpose of the opaque light modifier would be to reflect the light back toward the recessed reflector, thereby allowing light to escape from the space between the recessed reflector and the light modifier.

The reflector connects the lamp-fitting at the top section and spans outside the building surface. The connection between the lamp-fitting and the reflector is in one embodiment a mechanical or magnetic connection. The reflector is preferably detachably attached to the lamp-fitting. In another embodiment the lamp-fitting and the reflector are configured for threaded engagement. This type of connection may be advantageous as it makes it possible to remove the reflector and access other parts of the lamp and the position of the reflector may be adjusted by the degree of which the thread is engaged such that the reflector may be located adjacent to the surface of which the lighting device is being mounted. The reflector may also be permanently attached to the lamp-fitting, such as glued in place.

In one embodiment the lighting device further comprises a reflector attachment element in the shape of a tube with an outer thread and a collar at one end. The outer thread is configured for engaging with the lamp-fitting and the collar is configured for engaging with the reflector such that the reflector may be attached to the lamp-fitting when engaging the outer thread of the reflector attachment element with the lamp-fitting. The location of the reflector may be adjusted by the degree of which the thread of the reflector attachment element is engaged with the lamp-fitting.

In another embodiment the modular lighting device further comprises an extension element 27 configured for creating extra distance between the lamp-fitting and the reflector such that the modular lighting device may be fitted to deeper or larger lamp housings. This may especially be useful when mounting the lighting device in a housing from an existing installations where the size of the housing, specifically the height or depth, varies such that the standard parts of the lighting device may not be sufficient for attaching the new device. In yet another embodiment the extension element is configured for threaded engagement with the lamp-fitting at a first end and for threaded engagement with the reflector at a second end. The extension element may for example have a segment at one end with an inner thread for engaging with the lamp-fitting and a segment at the other end with an outer thread for engaging with the reflector as shown on the bottom drawing of FIG. 9. The extension element may be fabricated in various sizes, e.g. 20-50 mm, or 50-80 mm, or 80-110 mm, or 110-140 mm, or 140-200 mm. Additionally, two or more extension elements can be connected and used when necessary.

Figure 17:
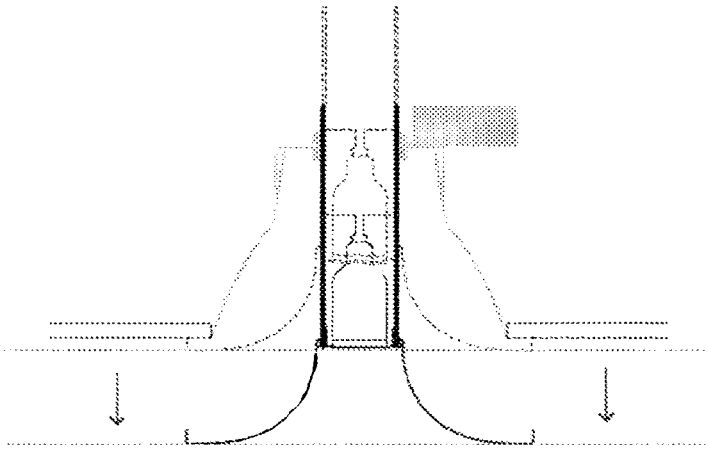
FIG. 17 shows, in cross-sectional side-view, three different configurations of the presently disclosed modular lighting device, wherein the lighting device comprises an acoustic element 34 for modifying sound, e.g. by absorption or reflection.
Figure 17:
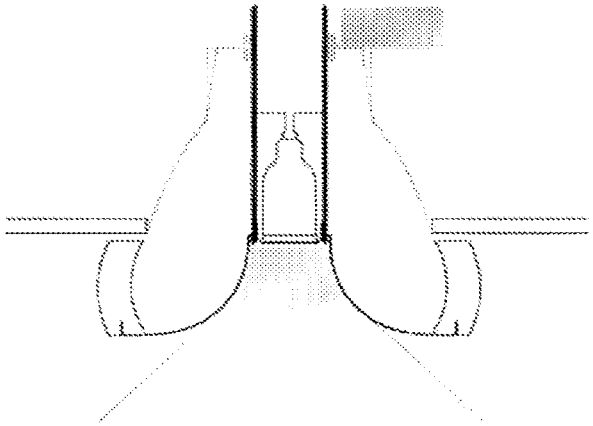
Figure 17:
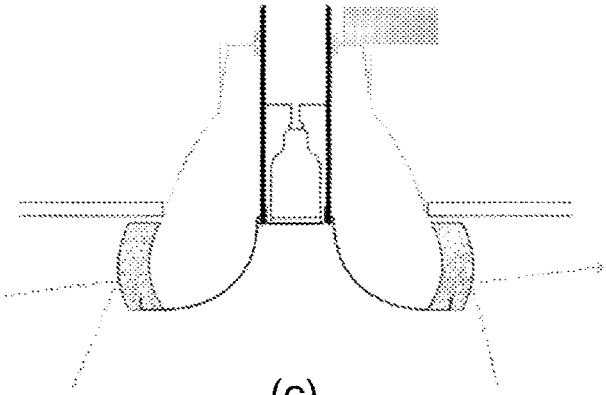
Figure 18:
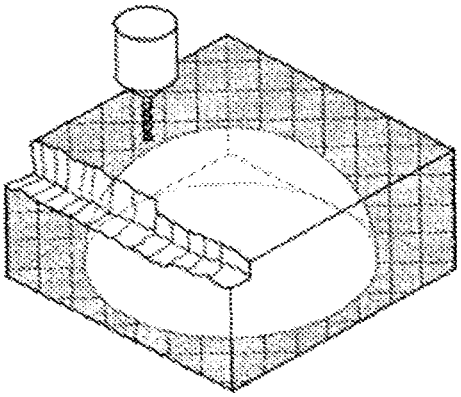
FIG. 18 shows various manufacturing techniques for fabricating an acoustic element and/or a pendant according to the present disclosure.
Figure 18:
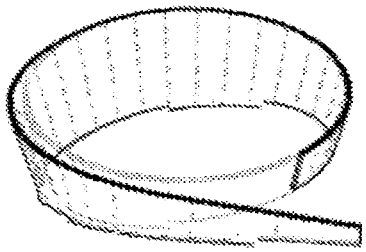
Figure 18:
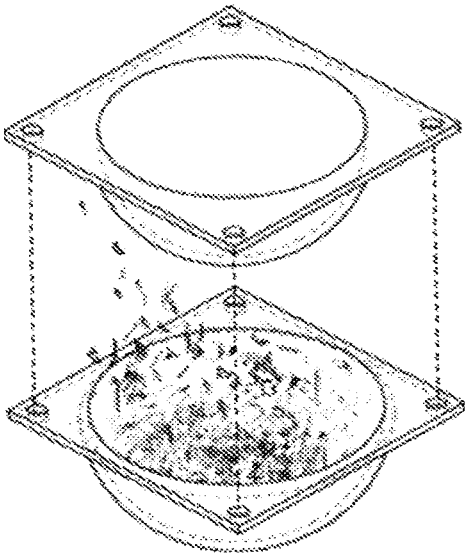
Figure 18:
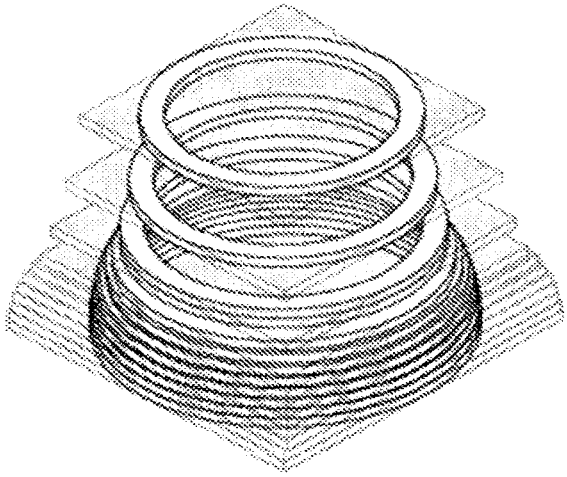
Figure 19:
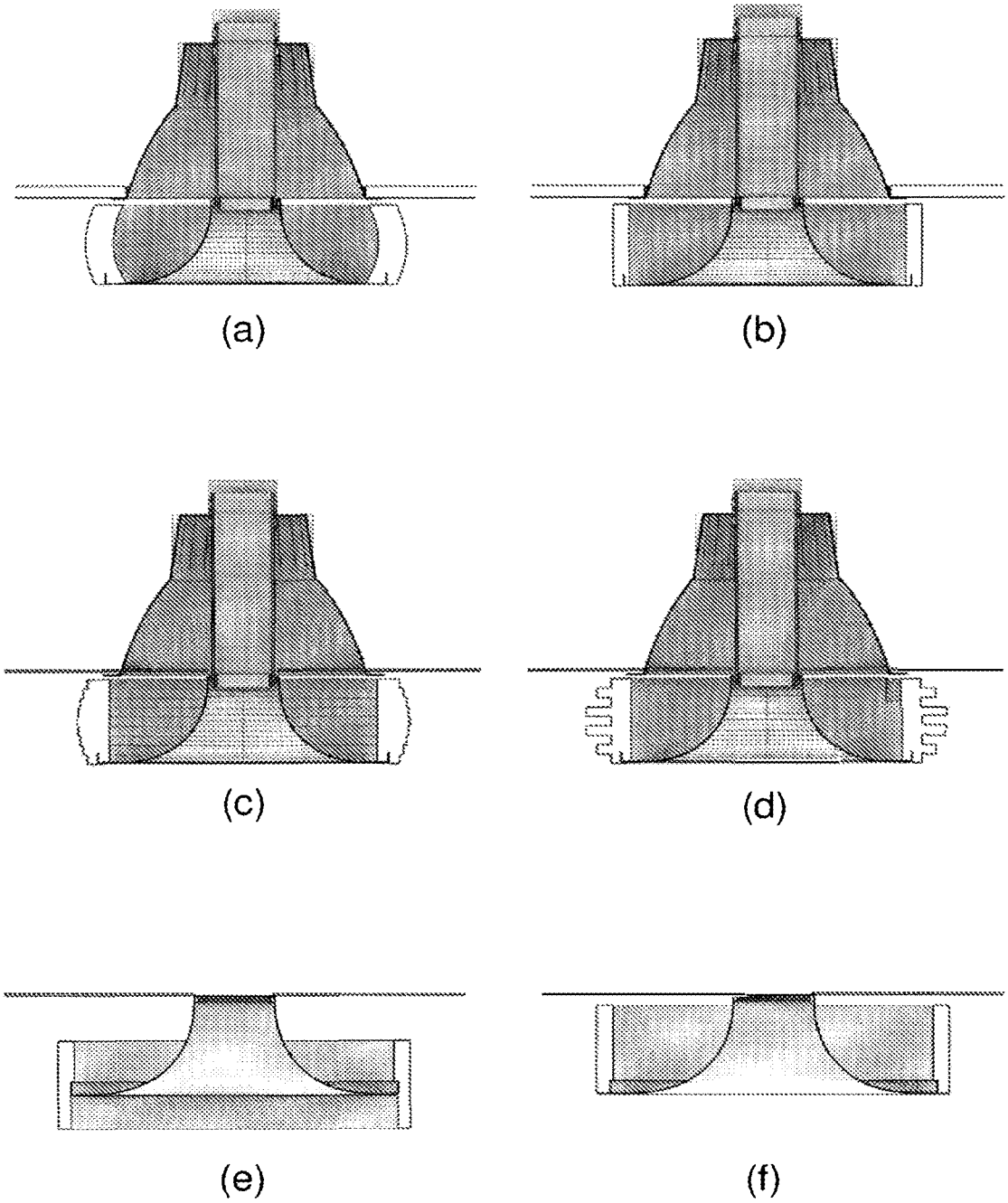
FIG. 19 shows, in cross-sectional side-view, different embodiments of the acoustic element integrated in the modular lighting device.
Figure 20:
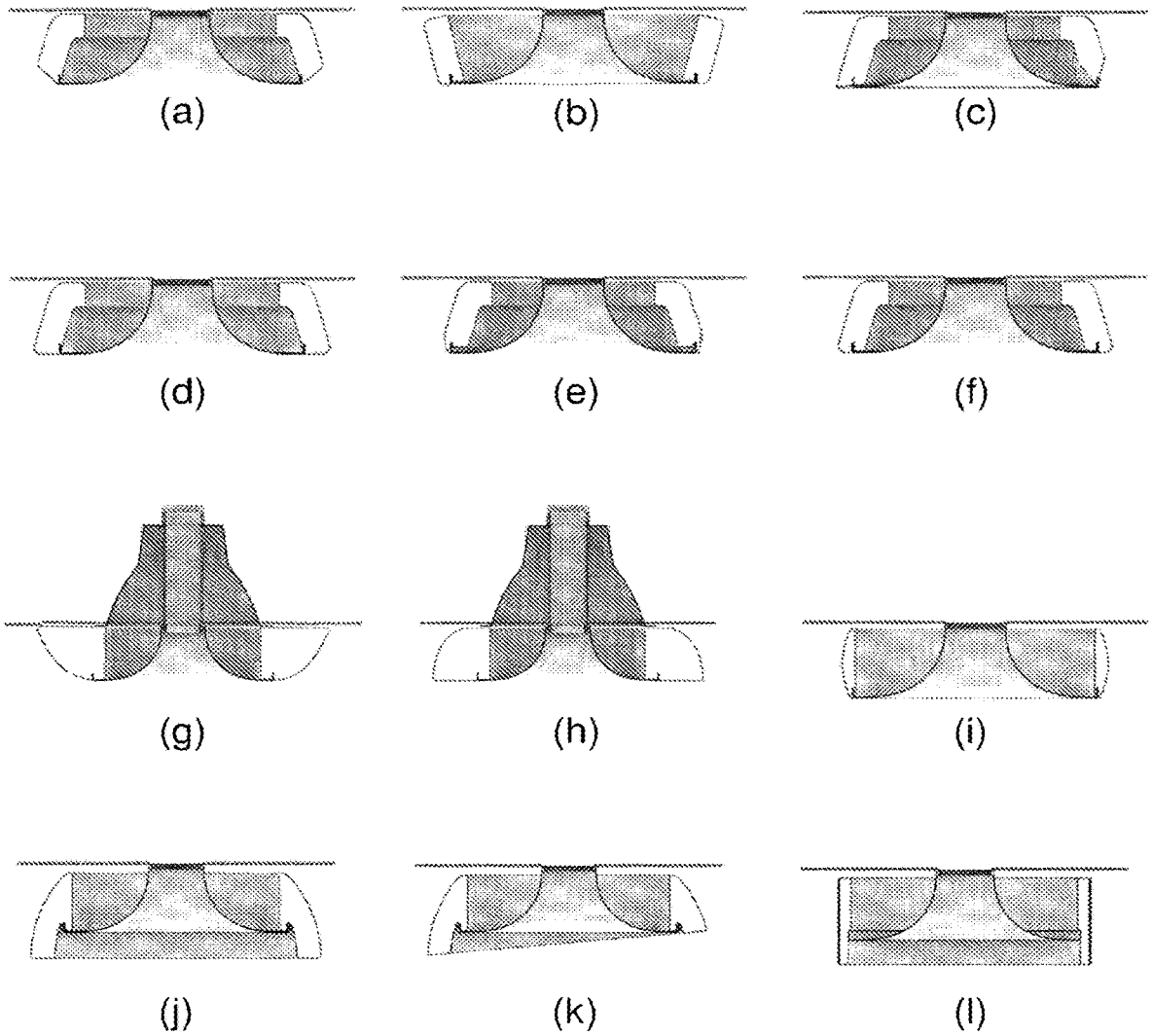
FIG. 20 shows, in cross-sectional side-view, different embodiments of the acoustic element integrated in the modular lighting device.
Figure 21:
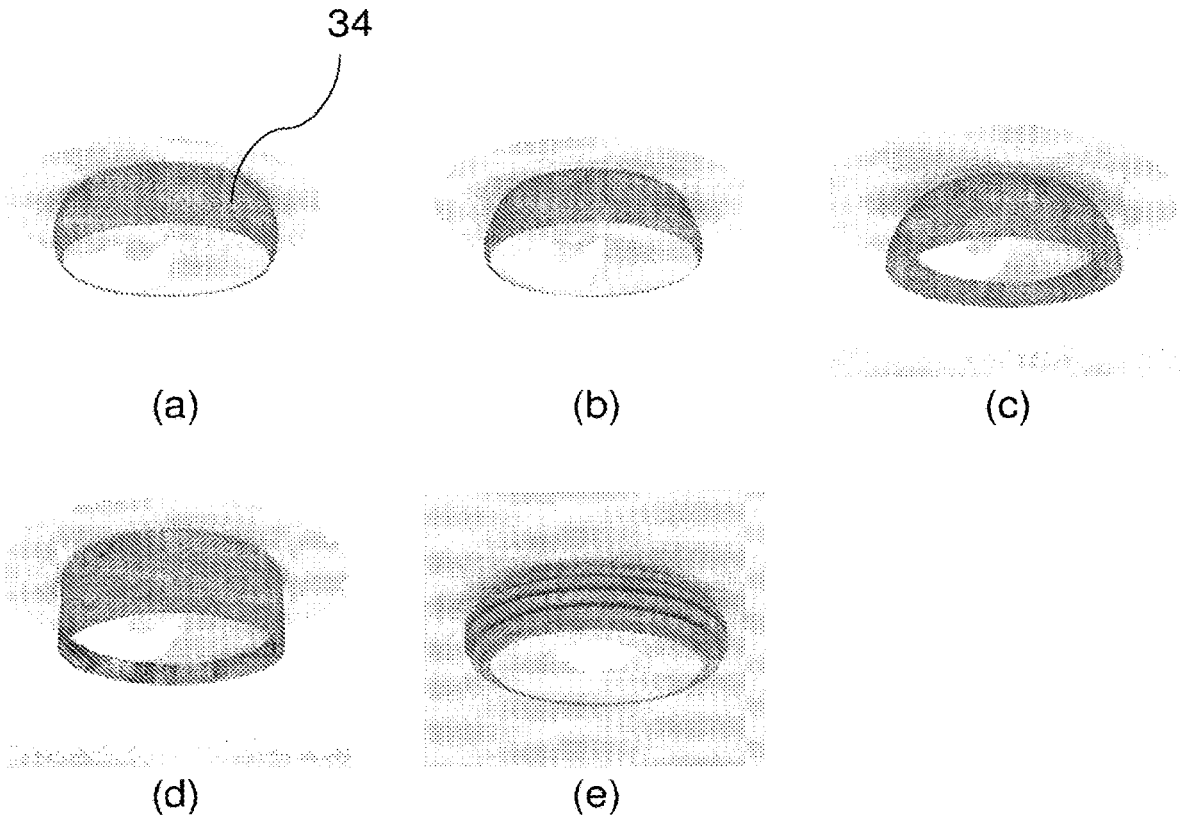
FIG. 21 shows various embodiments of the presently disclosed modular lighting device, wherein the lighting device comprises an acoustic element 34.

In another embodiment, the modular lighting device further comprises an acoustic element 34 configured for modifying and/or reflecting sound incident on the lighting device. The acoustic element is preferably fitted between the reflector and the wall/ceiling as shown in FIG. 17. The extra distance between the reflector and the ceiling may be accomplished by lowering the reflector and/or the lamp-fitting relative to the lamp-housing, e.g. by using the above-described extension element. Alternatively, the extra distance may be realised by providing a long lamp-fitting. The acoustic element is preferably made from a material that is suitable for absorbing energy from sound waves, e.g. mineral wool, cork, recycled denim, or eelgrass. The acoustic element may have various shapes and sizes for reflecting or redirecting sound waves as shown in FIGS. 19-21. It preferably extends along the entire circumference of the reflector of the modular lighting device as shown on FIG. 21. The upper edge of the acoustic element may be in contact with the surface of the wall/ceiling and the lower edge may follow the rim of the reflector. Alternatively, the lower edge may protrude below the reflector as seen on FIG. 21*c-d*. The acoustic element or acoustic lamp shade may be manufactured using a variety of methods such as milling, upholstery, moulding, or stacking of individual layers as shown in FIG. 18. The acoustic element shown in FIG. 17*c* has a convex shape such that part of the incident sound waves are redirected away from the source and another part of the energy is absorbed in the material. This contributes to a pleasant sound environment in proximity to the lamp device. The improved acoustics from the lamp device may be useful e.g. at a restaurant where it is desired that people can have a conversation at the dinner table without too much background noise from neighbouring tables. It could also be useful in an office, especially an open-plan office space.

Figure 22:
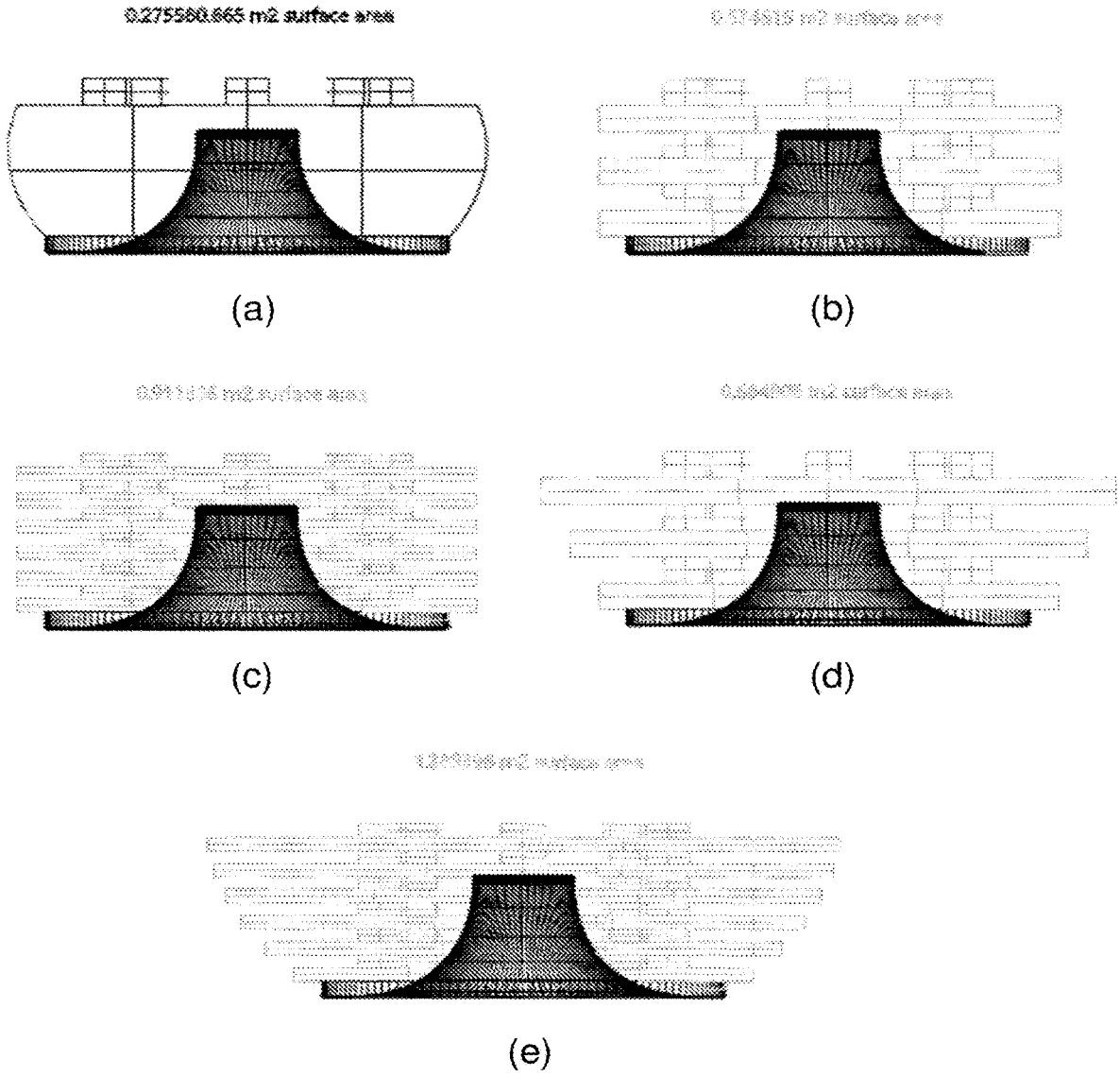
FIG. 22 shows, in cross-sectional side-view, different embodiments of the modular lighting device comprising an acoustic element of various surface areas.

In yet another embodiment, the modular lighting device comprises an acoustic element as described above, but wherein said acoustic element predominantly encloses the top part of the reflector of the lighting device as well as the circumferential parts of the reflector as shown on FIG. 22(*a*). The reflector is still visible from below such that it maintains its function of distributing the light from a light source fitted in the lamp-fitting of the lighting device.

The present invention is intended for refitting or retrofitting a new lighting device into an existing installation in a building. This means that one or more parts of the existing installation may be used when refitting the new lighting device. In one embodiment the modular lighting device is installed in the housing from a dismantled lamp already mounted in the building, such that the housing from the dismantled lamp is reused for installing the modular lighting device. In this manner the lamp-fitting may be attached to the housing e.g. by making a hole in the top part of the housing and attaching the lamp-fitting to the housing. This may be achieved by having a threaded exterior of the lamp-fitting and having nuts or some other parts engage with the lamp-fitting to secure it to the housing. Preferably, the bezel 3 of the lamp-fitting covers a substantial part of the outer surface of the lamp-fitting. This allows for the position of the lamp-fitting to be varied relative to the lamp-housing, such that lamp housings of different heights may be accommodated (cf. FIG. 9). The outer thread further facilitates an axial adjustment of the reflector attached to the lamp-fitting. Thereby, the position of the reflector may be adjusted, which has multiple purposes, e.g. accommodating different sized lamp-housings, covering different sized openings, and additionally allowing the reflector to extend below the surface to accommodate other elements such as acoustic materials. The latter may be achieved using an extension element as described above. The lamp-fitting may alternatively be secured by glue or some other permanent attachment method.

One purpose of the present invention is that it enables retrofitting of a new lighting device in place of an existing installation. Therefore, in one embodiment the modular lighting device is configured for covering the entire housing from the existing dismantled lamp. The reflector of the lighting device may have various diameters for fitting to different sizes of existing installations. In one embodiment, the outer diameter of the reflector is at least 90 mm, or between 90 mm and 440 mm, or between 130 mm and 380 mm, or between 170 mm and 320 mm, or between 210 mm and 260 mm. The reflector should also be designed in a way such that it fits holes from existing installations of various sizes in the best way possible. In another embodiment, the reflector is therefore configured for covering a hole from an existing installation with a diameter of at least 60 mm, or between 60 mm and 240 mm, or between 80 mm and 220 mm, or between 100 mm and 200 mm, or between 120 mm and 180 mm, or between 140 mm and 160 mm. The reflector may be configured for covering such holes by designing the shape and dimensions such that it does not touch the edge of the hole from the existing installation even when the outer diameter of the reflector is much larger than the hole from the existing installation. In yet another embodiment the modular lighting device is protruding less than 25 mm, or less than 15 mm, or less than 10 mm, or less than 7 mm, or less than 5 mm from the ceiling. It may in some cases be preferred that the lighting device protrudes as little as possible from the surface at which it is mounted.

In addition to being retrofitted in an existing installation, the modular lighting device should also preferably provide a pleasant and comfortable light in the area near the device. In some situations it may be preferred that the light is soft and not glaring or very direct. This may be provided by one embodiment of the invention where the modular lighting device further comprises a shade, aka a diffuser, for distributing, diffusing or refracting the light from the modular lighting device, said shade attached at a preselected distance below the reflector. The shade is preferably a thin round disk of a suitable material, but it can also take on other shapes, such as triangular, square, hexagonal or any other polygonal shape. The shade may be flat or it may be curved or rounded such as part of a sphere with a certain diameter. Even though the terminology shade is used, this does not mean that the shade always shadows the light from the lighting device. The shade may block all light or it may be semi-transparent or completely transparent.

In other embodiments where the device further comprises a shade, this is preferably large enough to provide a soft and comfortable light such that direct light from the light source is avoided. In one embodiment the diameter of the shade is as large as the outer diameter of the reflector or larger than 80% of the outer diameter of the reflector. This may be advantageous when the shade is transparent or opaque. In other embodiments the shade may be smaller, such that the diameter of the shade is less than 80%, or less than 60%, or less than 50%, or less than 40% of the outer diameter of the reflector. This size may be advantageous when the shade is not very transparent. In some embodiments the shade may even be absorbing light or it may be reflective such that light from the back of the shade is reflected back into the device before escaping the device. Thereby the light may also be made soft and comfortable. The shade may in one embodiment be attached to the lamp-fitting or to the reflector. Depending on the purpose and size of the shade it may be made from metal, such as brushed aluminum or polished aluminum, or made from glass, or clear plastic, or frosted glass, or opaque plastic, or a Fresnel lens, or a de-glaring prism.

Shaded Lighting Device

The present disclosure is furthermore related to a shaded lighting device comprising a reflector with a circumferential indentation or groove and a suspended shade, aka diffuser or light-modifier, for distributing, diffusing or refracting the light from the lighting device. Connection elements made from a resilient material are attached to the suspended shade such that it may be connected with the reflector. A resilient material is to be understood as a material that may be bent or deformed elastically upon applying a force and returns to its original shape when the force is removed. One purpose of the shade may be to provide a pleasant and comfortable light in the area near the lighting device such that the light is soft and not glaring or very direct. In one embodiment the lighting device is configured for being integrated into a ceiling or interior surface of a building. The device could also be integrated into any other surface, and could therefore be used for lamps located in e.g. walls or floors or other substantially planar surfaces. However, the present invention may also be used for retrofitting lamps located at exterior parts of a building such as outer walls or overhang of ceilings.

In one embodiment the circumferential indentation or groove is a concave rounding or bulge on the reflector. Alternatively, the indentation or groove could also be a square or rectangular notch, or it could be a v-shaped groove or indentation. However, a concave rounding may in some embodiments be advantageous as it may allow a better fit between the groove and the connection elements and may be less abrasive, especially when attaching and detaching the shade from the reflector. In another embodiment the connecting elements have a bulge or dent configured for engaging with the circumferential indentation or groove in the reflector. Preferably, the shape of the bulge or dent corresponds to the shape of the groove or indentation in the reflector. However, it may also be a different shape. In another embodiment the lighting device comprises at least 2, or at least 3, or at least 4 connection elements for attaching the suspended shade to the reflector. It is preferred that the device comprises 3 or more connection elements as this will provide a fixed orientation of the shade which is preferably parallel to the edge of the reflector.

The suspended shade for the shaded lighting device may be made from metal, such as brushed aluminium, or polished aluminum, or brushed steel, or polished steel. The shade may also be made from clear glass, or frosted glass, or clear plastic, or opaque plastic, or a Fresnel lens, or a de-glaring prism. The connection elements may be made from a metal such as steel, or aluminium, or brass, or an alloy, or they may be made from a plastic such as polyethylene terephthalate, polyethylene, polyvinyl chloride, polypropylene, polystyrene, acrylic (PMMA). The resilient material may in one embodiment be a springy material, such as hardened steel, which may be deformed upon applying a force and returns to its original shape when the force is removed. Transparent material may be advantageous for the connection elements as it does not block the light from the light source such that the connection elements are not as noticeable and may make the shade look suspended. Additionally, in another embodiment the connection elements are attached away from the edge of the suspended shade, such that the light from the shaded lighting device is not blocked by the connection elements.

Pendant Comprising an Acoustic Element

Figure 24:
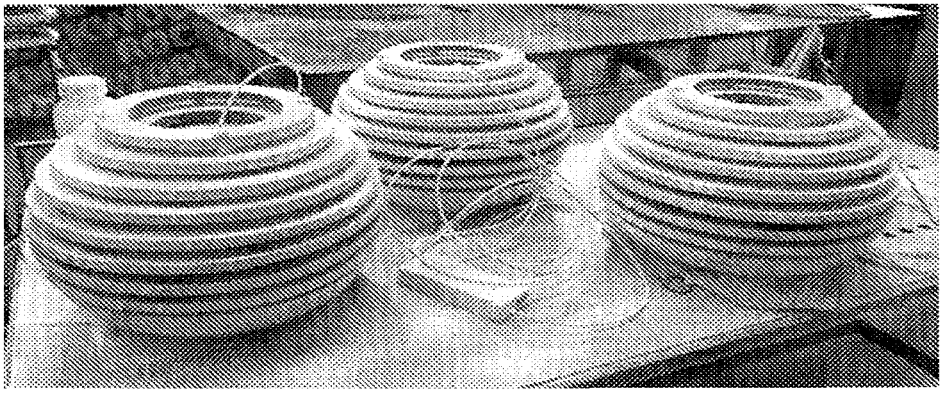
FIG. 24 shows three pendants, each pendant formed by stacking layers of material to form an acoustic element surrounding the reflector of the modular lighting device.

The present disclosure further relates to a pendant comprising an acoustic element. Preferably, the pendant comprises a reflector and a lamp-fitting according to the present disclosure, however the pendant may be used with other components of lighting devices. The reflector may be enclosed in said pendant such that only the inner surface of the reflector is visible from below. The pendant may be manufactured by stacking layers of material, preferably using a material that is suitable for absorbing energy from sound waves. Alternatively, the pendant may be manufactured using milling, upholstery, or moulding. In case stacking is chosen as the manufacturing technique, the stacked layers may constitute rings or discs of various diameter, wherein said rings or discs preferably surround the reflector of the lighting device. The stacked layers facilitate a large surface area, such that more sound energy is absorbed compared to a solid pendant or a pendant comprising a smooth outer surface. FIG. 22 shows various embodiments of a pendant comprising an acoustic material, wherein said acoustic material is shaped to form discs to increase the sound absorption. The various embodiments shown in FIG. 22 indicate how to realise different surface areas by shaping the acoustic material. Accordingly, the acoustic element of the pendant may have a surface area from about 0.2 $m^2$ to approximately 2 $m^2$ or even larger depending on the size of the reflector and the number of stacked layers. The pendant shown in FIG. 22(*e*) has the largest surface area of approximately 1.39 $m^2$. The pendant may be mounted directly to a building surface such as a wall or a ceiling. However, the pendant may alternatively be suspended from a ceiling, e.g. using an electrical cord connected to the lamp-fitting and/or the light source. FIG. 24 shows three pendants according to the present disclosure, wherein said pendants are suitable for being suspended from a ceiling.

DETAILED DESCRIPTION OF DRAWINGS

Figure 1:
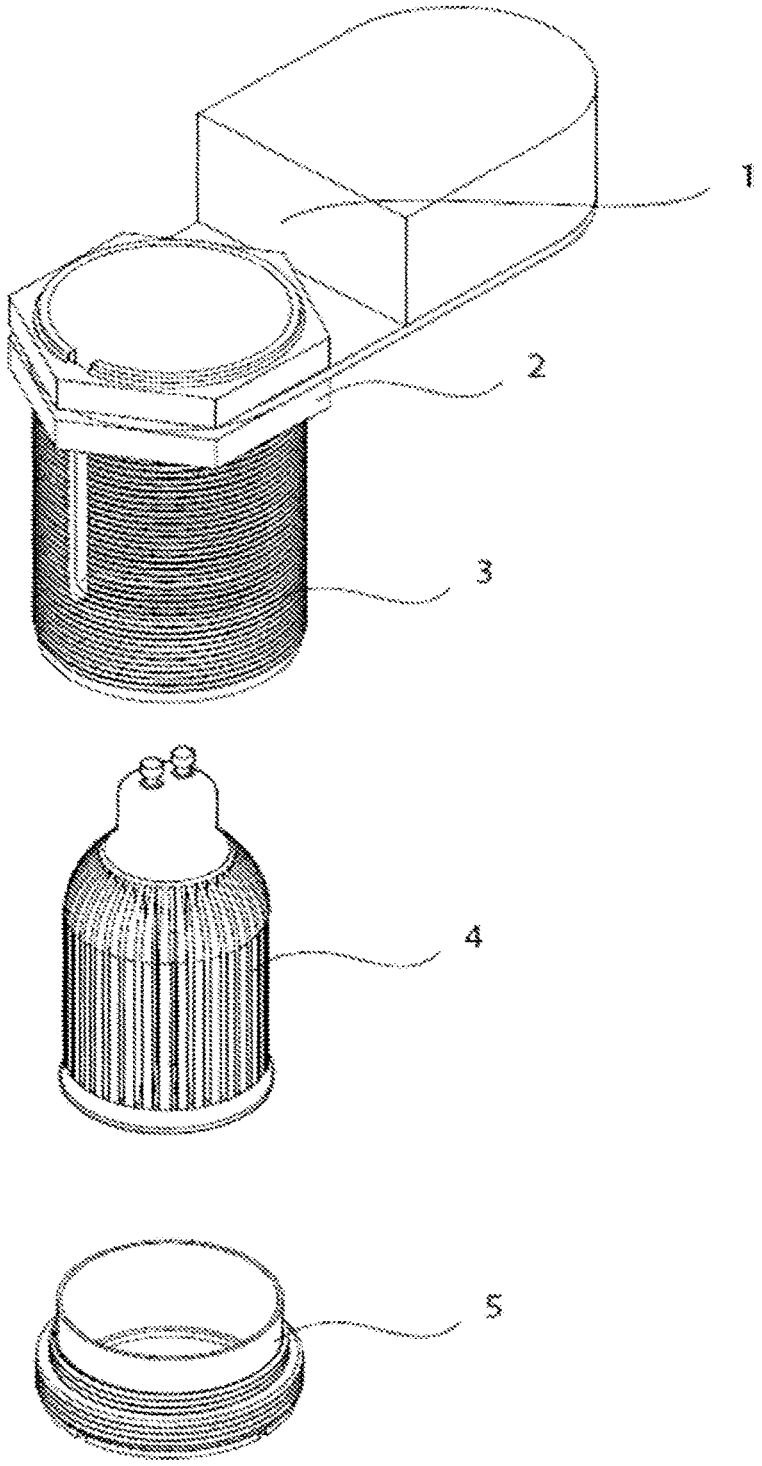
FIG. 1 shows an exploded view of an embodiment of the presently disclosed lamp-fitting and a corresponding light source.

FIG. 1 shows an exploded view of an embodiment of the presently disclosed lamp-fitting and a corresponding light source 4. The lamp-fitting comprises and electrical transformer 1, threaded bezel 3, two nuts 2 for attaching the bezel of the lamp-fitting to a lamp-housing and a collar to hold the light-source 4 in place.

Figure 2:
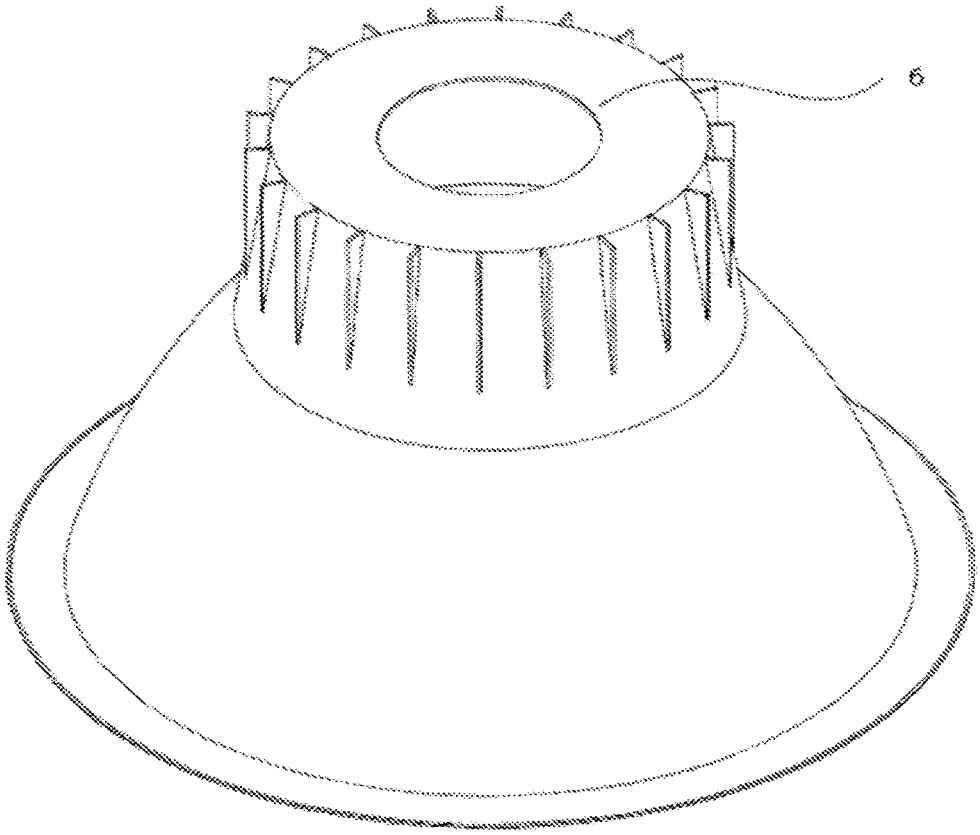
FIG. 2 shows a perspective view of a typical lamp-housing of an existing lamp installation.

FIG. 2 shows a perspective view of a typical lamp-housing 6 of an existing lamp installation, the lamp-housing having an aperture in the top section for application of the lamp-fitting there through.

Figure 3:
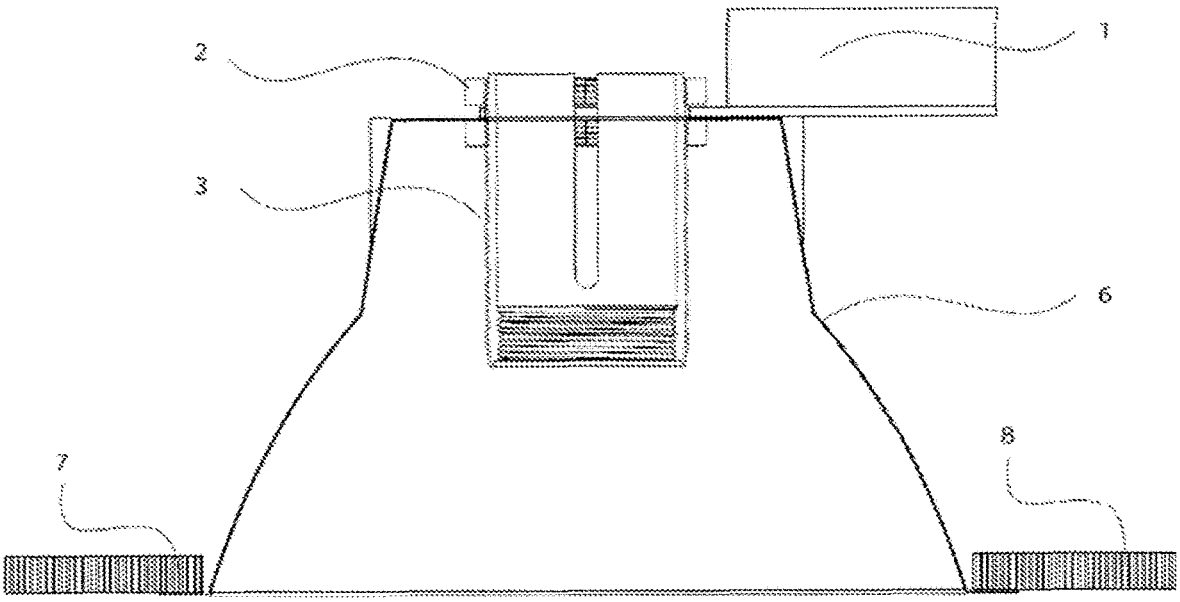
FIG. 3 is a cross-sectional side view of a lamp-housing with an exemplary lamp-fitting attached thereto.

FIG. 3 is a cross-sectional side view of a lamp-housing 6 with an exemplary lamp-fitting attached thereto. The lamp-housing is seen to extend to just below the building surface 8, with an overlapping part 7 between bottom perimeter of lamp housing 6 and the rim of the opening of the building surface 8. The electrical transformer, the nuts and the bezel 3 of the lamp fitting are also visible in FIG. 3 and it is seen that the lamp fitting is attached to a top section of the lamp housing where the bezel 3 is held in place the aperture of the lamp housing by means of two nuts 2.

Figure 4:
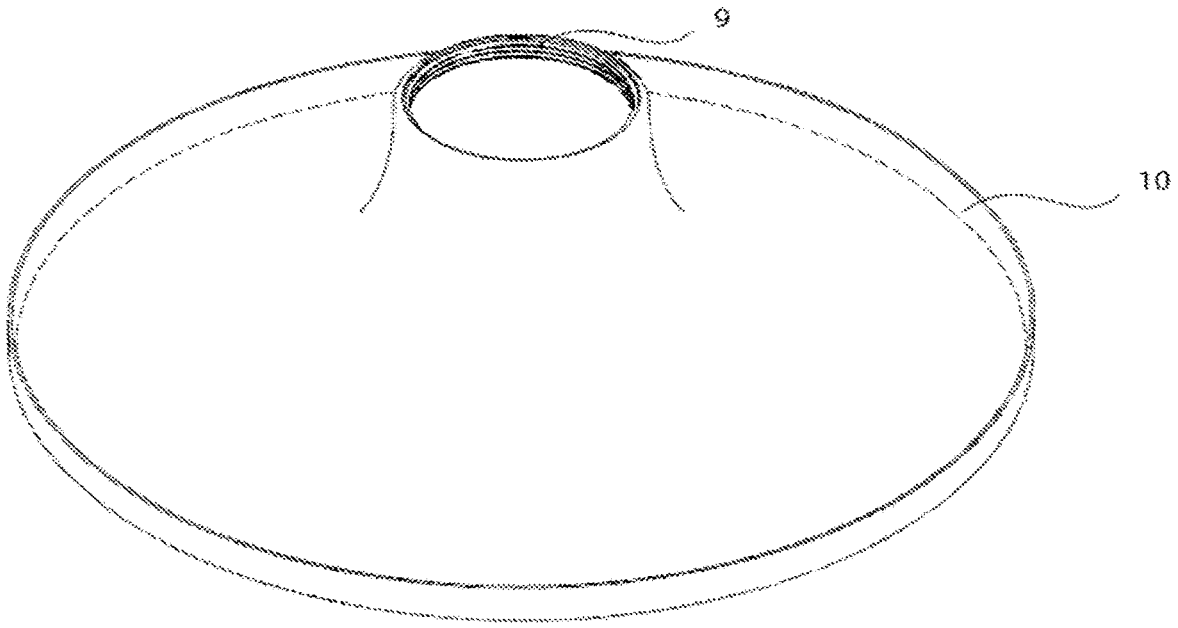
FIG. 4 is a perspective view of one embodiment of the reflector.

FIG. 4 is a perspective view of one embodiment of the reflector showing an inner thread 9 at the narrow top section of the reflector for threaded engagement with the lamp-fitting. The threaded engagement allows the position of the reflector to be axially adjusted relative to the lamp-fitting. A fold back rim 10 is provided around the bottom perimeter of the reflector.

Figure 5:
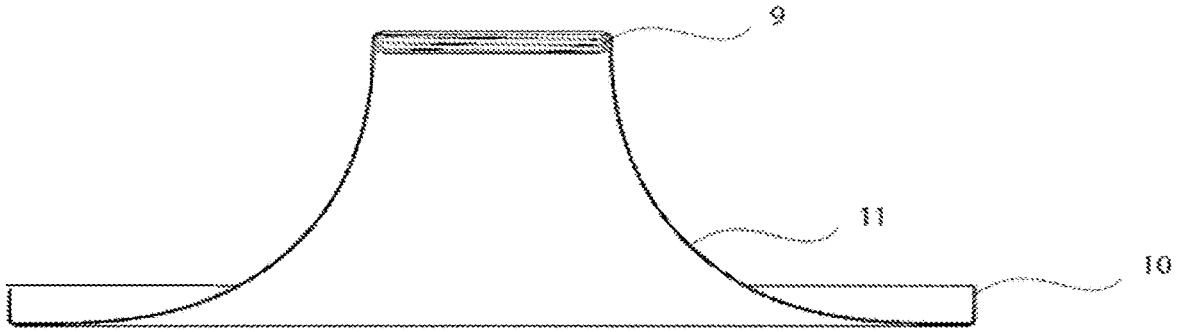
FIG. 5 is a cross-sectional side view of one embodiment of the reflector.

FIG. 5 is a cross-sectional side view of one embodiment of the reflector showing the convex surface and the fold back rim 10 and the inner thread 9 for engagement with the lamp-fitting.

Figure 6:
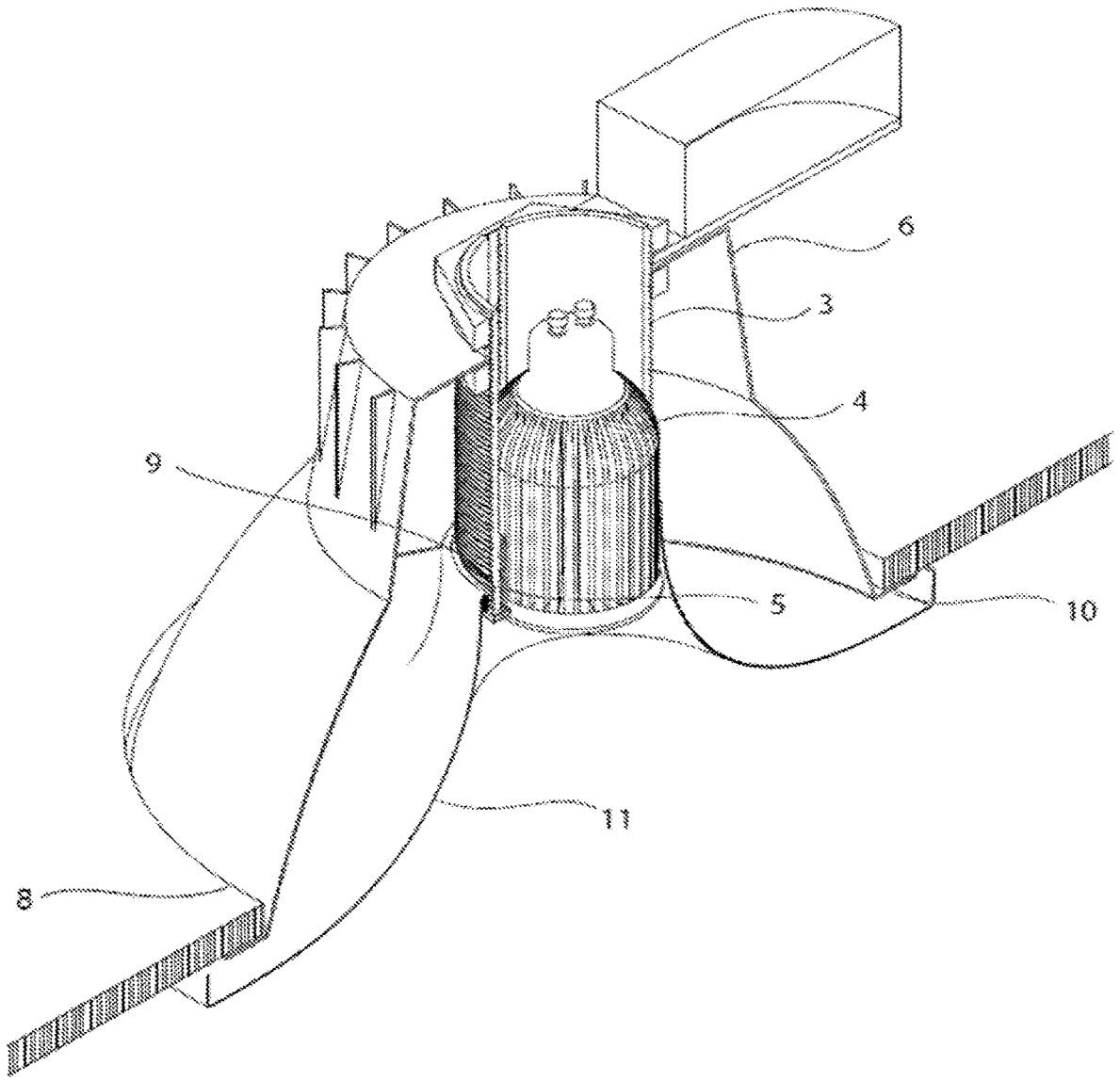
FIG. 6 is a cross-sectional perspective view of a lamp-housing with one embodiment of the presently disclosed modular lighting device attached thereto.

FIG. 6 is a cross-sectional perspective view of a lamp-housing 6 with one embodiment of the presently disclosed modular lighting device attached thereto. As seen from FIG. 6 the lamp housing and modular lighting device is countersunk into an opening in the building surface 8. The bottom perimeter of the lamp housing 6 is plane with the outside of the building surface 8 at the area 10. The lamp-fitting is attached to the lamp housing 6 by means of bezel 3 and the reflector is attached to the threaded bezel 3 by means of thread 9. The light source 4 is held in bezel by means of collar 5. The convex screen 11 of the reflector extends from the bezel and out through the opening in the building surface 8 thereby covering the opening and the lamp housing 6. The fold back rim 10 on the reflector ensures that the reflector abuts the building surface 8 to completely cover the lamp housing 6. The position the reflector relative to the opening in the building surface can be adjusted by the position of the lamp fitting in the lamp housing and also by the position of the reflector relative to the lamp fitting, in the example in FIG. 6 these positions can be adjusted by the threaded engagements.

Figure 7:
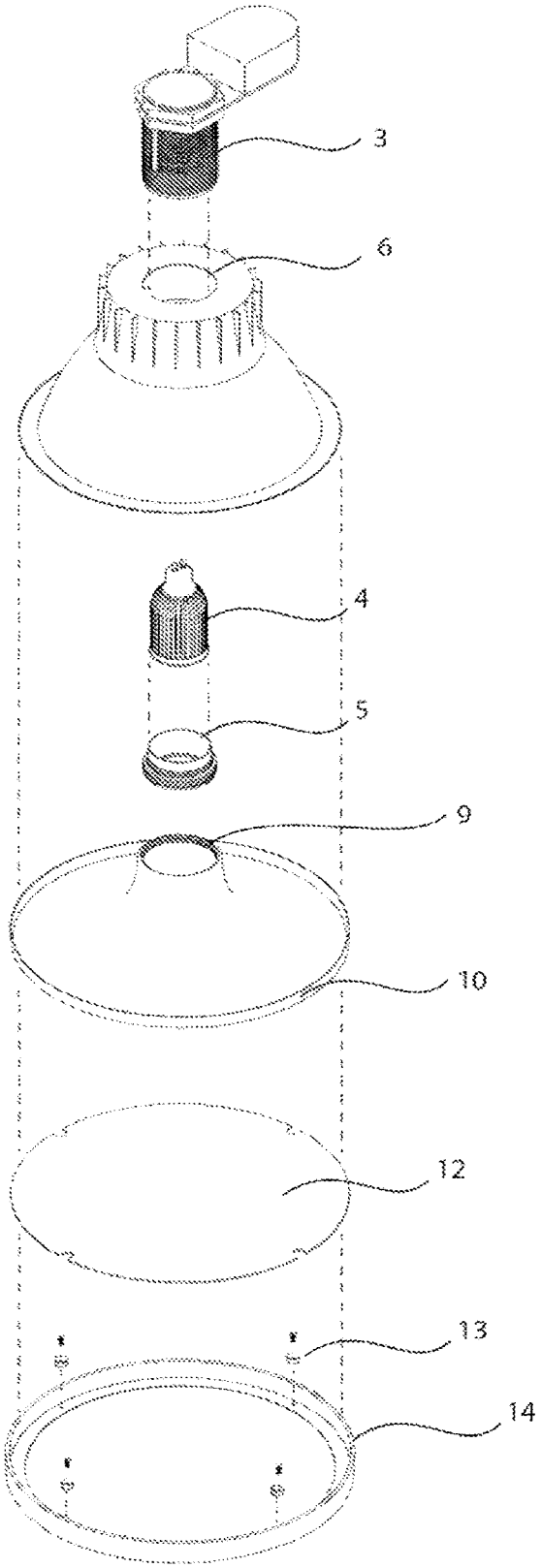
FIG. 7 shows an exploded view of one embodiment of the presently disclosed modular lighting device and the corresponding lamp housing.

FIG. 7 shows an exploded view of one embodiment of the presently disclosed modular lighting device and the corresponding lamp housing corresponding to the setup in FIG. 6 with a further diffuser 12 below the reflector which is held in place by a holding-ring 14 and a magnetic attachment secured by screws 13.

FIG. 8 shows various alternative topological configurations of reflectors. With rectilinear perimeter with filleted walls and cylindrical recessed zone 15, rectilinear perimeter with sharp vertices, flat base and planar recessed zone 16, round perimeter with filleted vertices and conical recessed zone 17, rectilinear perimeter with sharp vertices, and planar recessed zone 18, amorphous perimeter with trumpet-like recessed zone 19, rectangular perimeter with planar recessed zone built from convex curves 20, rectilinear perimeter with filleted vertices, and filleted, planar recessed zone 21, rectangular perimeter with sharp vertices, and planar recessed zone 22 and round perimeter with sharp vertices and conical recessed zone 23.

FIG. 9 shows, in cross-sectional side-view, three different views of the presently disclosed modular lighting device and the corresponding lamp housing, the difference being the size of the lamp housing. The smallest lamp housing is in the top drawing 24 and the top part of the reflector extends almost to the top part of the lamp housing 6. As seen from the top drawings the light source is retracted almost to the top part of the reflector, but the position of the light source relative to the reflector can be adjusted further downwards. In the middle drawing 25 the lamp housing 6 is taller than in the top drawing, and the position of the light source in the reflector is a bit lower. Thus, the threaded engagement between the lamp-fitting and the reflector allows for the position of the two to be axially varied relative to each other. This has the technical effect that different sized lamp housings (e.g. different sized heights) may be accommodated by the modular lighting device. The highest lamp housing is shown in the bottom drawing 26. In this example, the lamp housing is so tall that it has been necessary to extend the bezel 3 of the lamp fitting by means of the collar 5. An outside thread on the collar 5 engages with the thread 9 of the reflector, such that the reflector can be attached to the collar in extension of the bezel 3. It is further apparent from the bottom drawing 26 that the opening in the wall/ceiling is wider than in the previous two cases. Hence, the presently disclosed modular lighting device is configured for accommodating different sized lamp housings and further configured for covering different sized openings in walls and/or ceilings.

FIGS. 10, 11 and 12 show one embodiment of a light modifier whereby a diffuser 12 (or lens) is held in place by a holding-ring 14. Magnets 13 are fixed to the holding ring 14 by means of screws. The magnets ensures the holding-ring can be fixed to the reflector through indents 28 in the diffuser. Hence, the holding-ring fixes the diffuser to the reflector.

Figure 13:
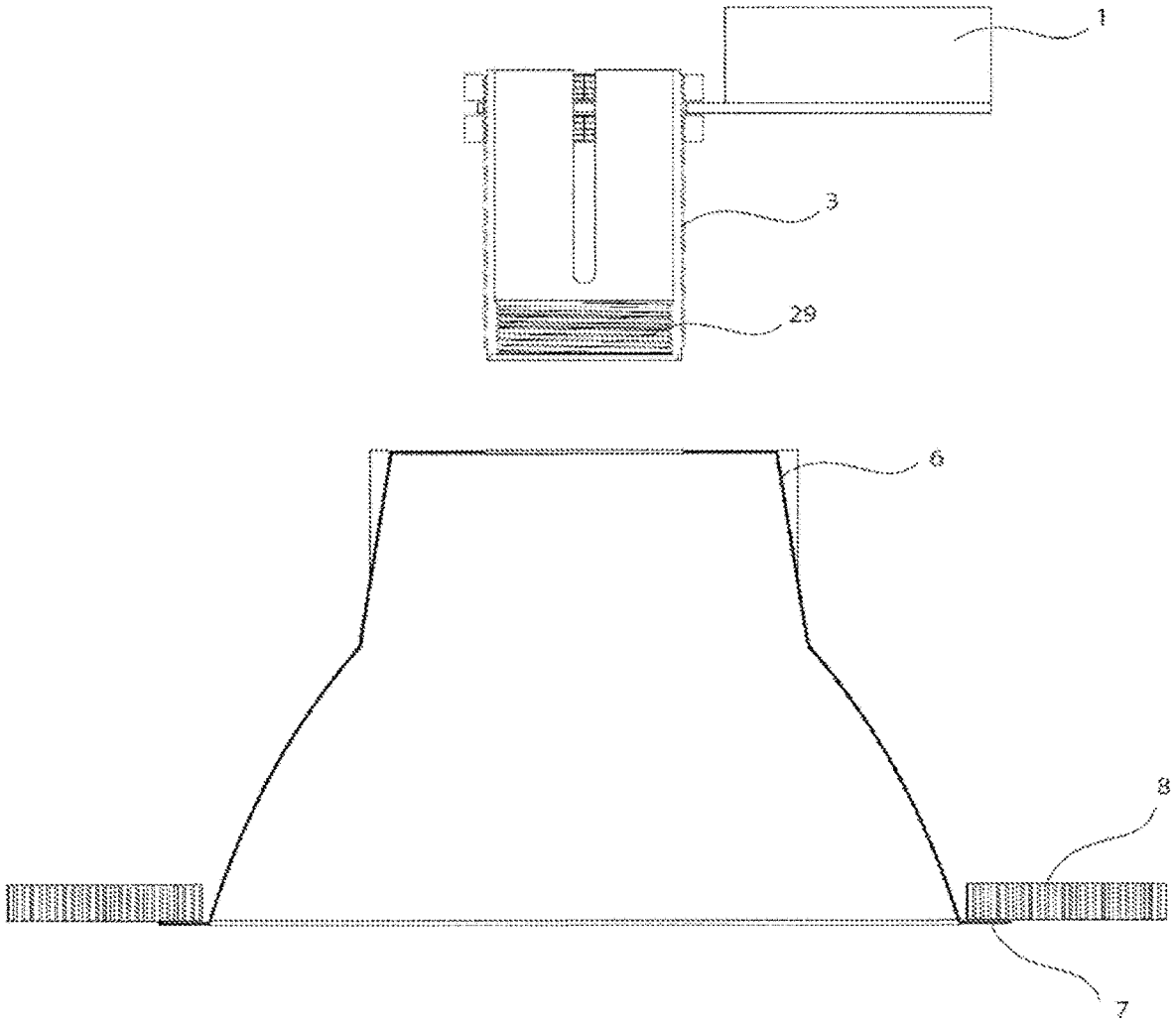
FIG. 13 illustrates in cross-sectional side view, the mounting of a lamp-fitting into an aperture of the top section of a lamp housing.

FIG. 13 illustrates in cross-sectional side view, the mounting of an exemplary lamp-fitting into an aperture of the top section of a lamp housing. FIG. 13 also illustrates an internal thread 29 in the bottom part of the bezel 3 of the lamp fitting. The internal thread 29 is used for securing the collar 5 when securing a light source to the lamp fitting.

Figure 14:
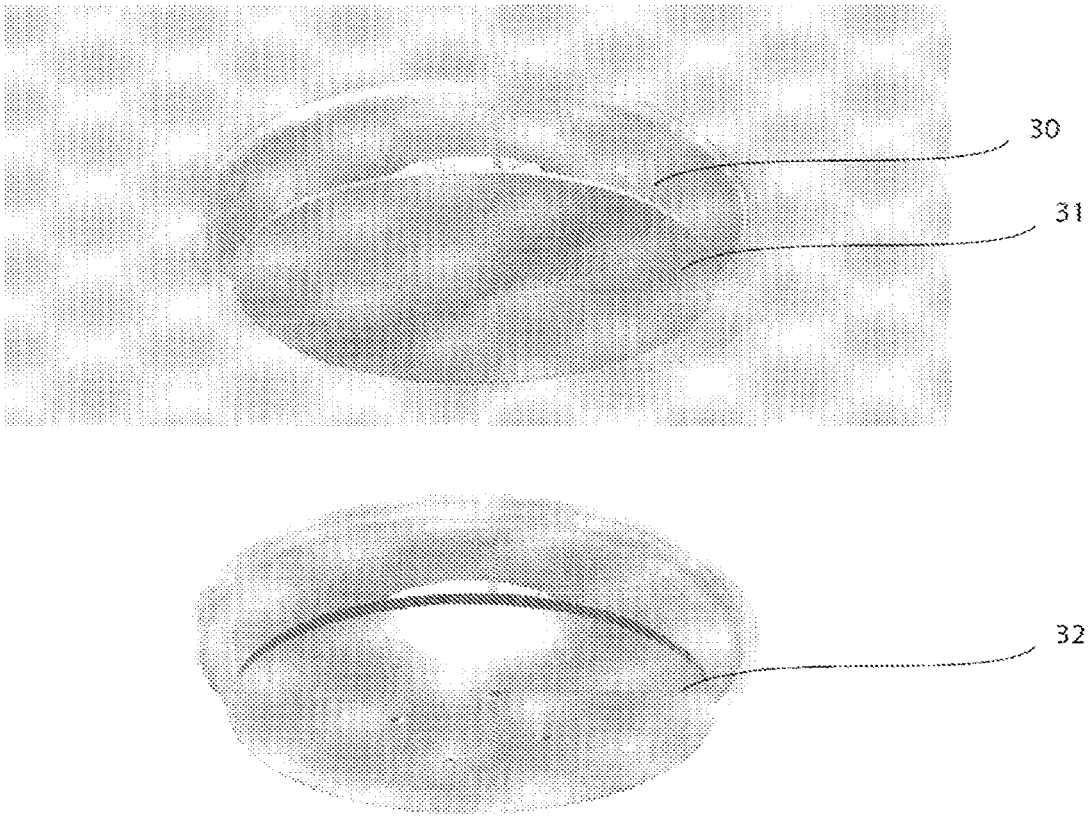
FIG. 14 shows a perspective view from below diffusors hanging below a reflector. In the top drawings light from the light source will primarily be emitted in the space between the diffuser and the reflector because the diffuser is opaque. In the bottom drawing the diffusor is translucent.

FIG. 14 shows a perspective view from below diffusors hanging below a reflector of a modular light source installed through an opening in a building surface. In the top drawing light from the light source will primarily be emitted in the space 30 between the diffuser 31 and the reflector because the diffuser 31 is opaque. In the bottom drawing the illustrated diffuser 32 is translucent such that much more light is emitted through the diffuser 32.

Figure 15:
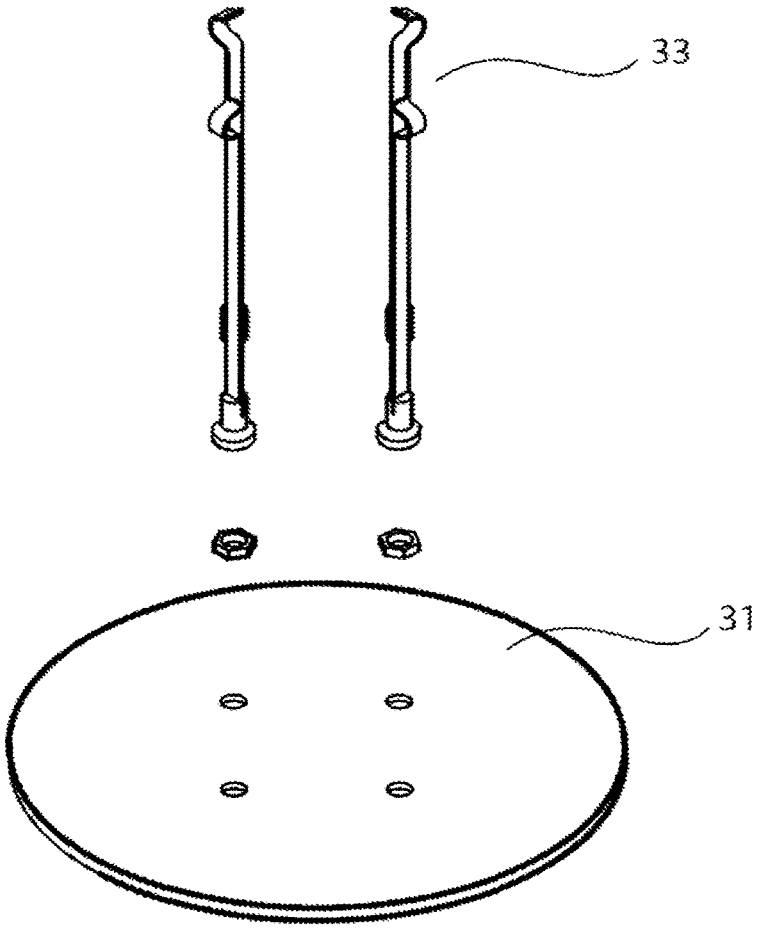
FIG. 15 is an exploded view of a diffuser and an example of an attachment element connecting the diffuser to the lamp-fitting.

FIG. 15 is an exploded view of a diffuser 31 and an example of an attachment element 33 connecting the diffuser to the lamp-fitting. In the example shown in FIGS. 10-12 the diffuser sits close to the reflector. However, in other instances it may be preferred that a diffuser hangs below the reflector, e.g. such that light is emitted in the gap between the diffuser and the reflector, as illustrated in the top drawing in FIG. 14. A gap between the diffuser 31 and the reflector can be provided by elongated attachment elements as illustrated in FIG. 15. Two elongated attachment elements 33 are shown in FIG. 15, but four attachment elements 33 are needed in this case because there are four apertures for the attachment elements 33 in the diffuser 31. The bottom end of the attachment elements 33 are fixed to the diffuser 31. The top side of the attachment elements 33 comprise a protrusion and a hook that can grab the lamp-fitting thereby attaching the diffuser 21 below the reflector.

Figure 16:
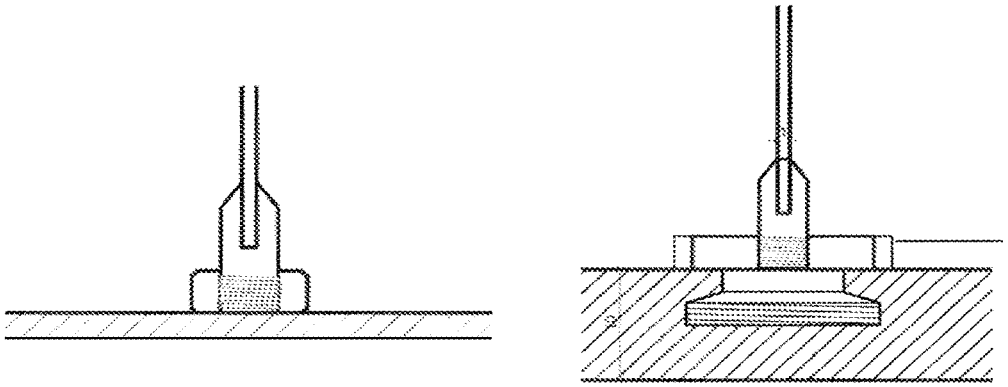
FIG. 16 shows two cross-sectional side views of how a diffuser can be mounted.

FIG. 16 shows two cross-sectional side views of examples of how a diffuser 31 can be secured to the bottom part of an attachment element 33. The left drawing in FIG. 16 shows the attachment element 33 which is screwed into the surface of the diffuser 31. The right drawing in FIG. 16 shows a nut which in integrated in the surface of the diffuser 31 such that the bottom part of the attachment element 33 can engage with the nut.

FIG. 17 shows, in cross-sectional side-view, three different views of the presently disclosed modular lighting device and the corresponding lamp housing, wherein the lighting device comprises an acoustic element for modifying the sound in the environment, preferably by absorbing a part of the energy of the sound waves incident on the acoustic element and/or by reflecting said sound waves. In this example, the surface of the acoustic element resembles part of a torus, and the acoustic element extends along the entire circumference of the reflector.

FIG. 18 shows various manufacturing techniques suitable for fabricating the acoustic element of the modular lighting device.

FIG. 19 shows, in cross-sectional side-view, various embodiments of the presently disclosed modular lighting device comprising an acoustic element. The element may have different shapes and may be formed from different processes such as: (a) torus-shaped formed by milling, (b) cylindrically shaped formed by milling, (c) torus-shaped formed by stacking layers of material, (d) similar to (c) but with more spacing between the layers. FIG. 19(*e*) shows an embodiment of the lighting device, wherein the acoustic element leaves a space between said element and the surface, by hanging the acoustic element on the lower rim of the reflector. FIG. 19(*f*) is similar to (e) but with less gap above the acoustic element.

FIG. 20 shows, in cross-sectional side-view, various shapes of the acoustic element. In most of the examples, the parts of the modular lighting device hidden behind the wall/ceiling are omitted from the figure.

FIG. 21 shows various embodiments of the presently disclosed modular lighting device, wherein the shape and size of the acoustic element varies among the embodiments.

FIG. 22 shows, in cross-sectional side-view, different embodiments of the modular lighting device, wherein the lighting device comprises an acoustic element that is formed by stacking layers of material suitable for absorbing energy from sound waves. The different embodiments have different surface area of the acoustic element. It is evident from the figure that the surface area may be controlled by the number of stacked layers and/or the diameter/width of said layers.

Figure 23:
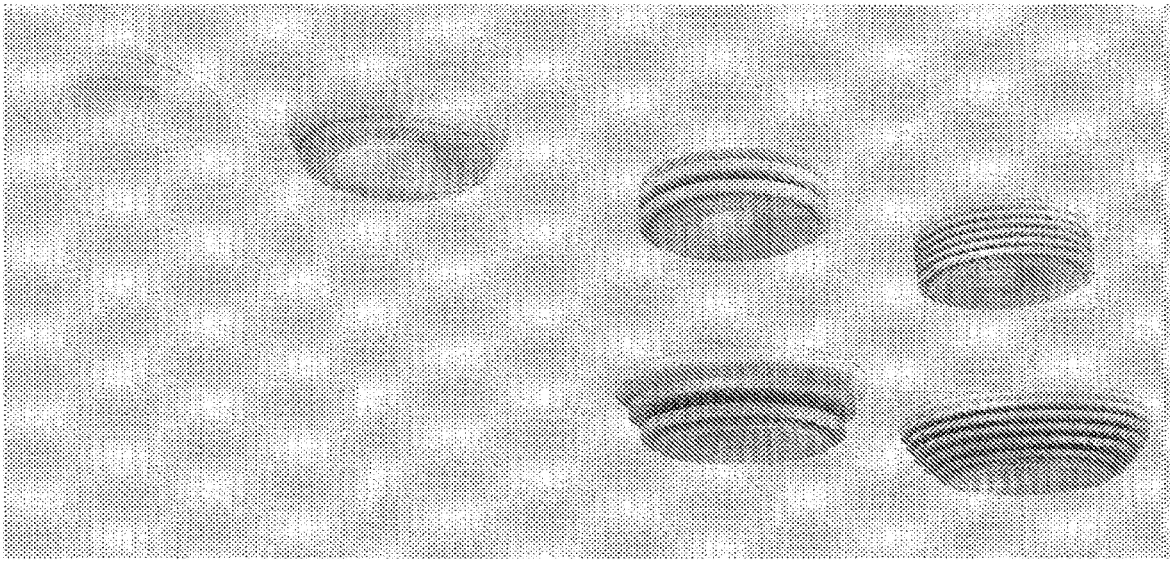
FIG. 23 shows, in 3D perspective, different embodiments of the modular lighting device comprising an acoustic element of various surface areas.

FIG. 23 shows, in perspective 3D view, different embodiments of the modular lighting device comprising an acoustic element formed by stacking layers of material. The leftmost drawing shows a reflector for comparison.

FIG. 24 shows three pendants enclosing the reflector and lamp-fitting of the modular lighting device. The acoustic element of the pendants is preferably made of a material that is suitable for absorbing energy from sound waves. The stacked layers has the technical effect of increasing the surface area of the acoustic element in order to absorb more energy than a corresponding smooth surface, such that the pendants dampens sound in the room.

FURTHER DETAILS OF THE INVENTION

1. A modular lighting device for retro-fitting to an existing lamp housing which is flush mounted or countersunk into an opening of a ceiling or interior surface of a building, the modular lighting device comprising:
   a lamp-fitting configured for receiving a light source and configured for attachment to the existing lamp housing, and
   a reflector for reflecting and/or modifying light from the light source, the reflector comprising a narrow top section configured for attachment to said lamp-fitting, and a wider bottom section for covering said opening.
2. The modular lighting device according to item 1, wherein the shape of the reflector is configured such that the part that connects to the lamp-fitting is recessed behind the finished ceiling surface or building surface.
3. The modular lighting device according to the preceding items, wherein the modular lighting device is configured for being integrated into said opening of said ceiling or interior surface, and wherein the shape of the reflector is a convex curve and the shape is such that the reflector connects and/or spans the lamp-fitting and the ceiling.
4. The modular lighting device according to the preceding items, wherein the perimeter of the bottom section of the reflector is configured for overlapping the existing lamp-housing in its connection to the ceiling or interior surface
5. The modular lighting device according to the preceding items, wherein the shape of the reflector is configured to adapt to the range of opening sizes in ceilings or interior surfaces which lie between the girth of the recessed portion of the reflector and the outer perimeter of the reflector
6. The modular lighting device according to the preceding items, wherein the bottom section of the reflector comprises a rim at the perimeter thereof, wherein said rim extends back towards the top section of the reflector.
7. The modular lighting device according to any of the preceding items, wherein the top section of the reflector is attached to the lamp-fitting by means of mechanical, magnetic, friction, pressure, adhesion or a combination thereof.
8. The modular lighting device according to any of the preceding items, wherein a bottom part of the lamp-fitting and the top section of the reflector are configured for threaded engagement.
9. The modular lighting device according to any of the preceding items, wherein at least part of the shape of the reflector is an exponential curve, or a hyperbola, or part of a parabola, or part of a circle such as a quarter of a circle, or part of an ellipse such as a quarter of an ellipse.
10. The modular lighting device according to any of the preceding items, wherein the reflector is fabricated from brushed aluminum, or polished aluminum, or plastic.
11. The modular lighting device according to any of the preceding items, further comprising a reflector attachment element in the shape of a tube with an outer thread and a collar at one end, wherein the outer thread is configured for engaging with the lamp-fitting and the collar is configured for engaging with the reflector such that the reflector may be attached to the lamp-fitting when engaging the outer thread of the reflector attachment element with the lamp-fitting.
12. The modular lighting device according to any of the preceding items, configured such that the bottom section of the reflector is protruding less than 25 mm, or less than 15 mm, or less than 10 mm, or less than 7 mm, or less than 5 mm from the ceiling or interior surface. The modular lighting device according to any of the preceding items, further comprising an extension element configured for being attached between the top section of the reflector and a bottom section of the lamp-fitting, configured for creating extra distance between the lamp-fitting and the reflector such that the modular lighting device may be fitted to deeper or larger lamp housings.
13. The modular lighting device according to item 12, wherein the extension elements may comprise either a double-threaded nut or extended collar or combination of both which are configured for threaded engagement with both the lamp-fitting and for threaded engagement with the reflector.
14. The modular lighting device according to any of the preceding items, further comprising a light-modifier for distributing, diffusing or refracting the light from the light-source housed in the lamp-fitting of the modular lighting device, said light-modifier attached mechanically, magnetically or otherwise to the reflector. or otherwise to the lamp-fitting.
15. The modular lighting device according to item 14, the light modifier further comprising:
   a holding-ring which has the capacity to encapsulate a lens or diffuser, and said diffuser, made from a translucent or transparent resilient material which is held in place by the said holding-ring
   a diffusor, lens or transparent or translucent light modifying medium located within the holding ring which is secured between the holding ring and the recessed reflector wherein the light-modifier is attached to the recessed reflector 16. The modular lighting device according to any of items 14-15, wherein the light-modifier is made from opaque material, such that the purpose of the light modifier would be to reflect the light back toward the recessed reflector, thereby allowing light to escape from the space between the recessed reflector and the light modifier
17. The modular lighting device according to any of items 14-16, wherein the light-modifier is translucent or transparent, or a Fresnel lens, or a de-glaring prism.
18. The modular lighting device according to any of the preceding claims, further comprising an acoustic element for modifying the sound in proximity to the lighting device, said acoustic element attached mechanically, magnetically or otherwise to the reflector.
19. The modular lighting device according to any of the preceding claims, wherein the acoustic element is configured for dampening the sound in the environment by absorbing energy from the sound waves and/or by reflecting the sound waves incident on the acoustic element.
20. The modular lighting device according to any of the preceding claims, wherein the acoustic element extends along the entire circumference of the reflector.

21. The modular lighting device according to any of the preceding claims, wherein the outer surface of the acoustic element resembles at least partially that of a torus.
22. The modular lighting device according to any of the preceding claims, wherein the outer surface of the acoustic element is cylindrical with straight walls.
23. The modular lighting device according to any of items 14-17, further comprising:
    a suspended material for distributing, diffusing focusing or refracting the light from the lighting device, or
    a suspended material for reflecting the light back from the lighting device such that the light escapes from the gap between the recessed reflector and the light-modifier, and
    connection elements made from a resilient material and attached to the lamp-fitting, wherein the light-modifier is attached to the lamp-fitting.
24. The lighting device according to items 23, wherein the connection elements are attached away from the edge of the suspended light-modifier, such that the light from the lighting device is not blocked by the connection elements.
25. The modular lighting device according to any of items 14-24, wherein the suspended light-modifier is made from metal, such as brushed aluminum or polished aluminum, or made from glass, or frosted glass, or clear plastic, or opaque plastic, or a Fresnel lens, or a de-glaring prism.
26. The modular lighting device according to any of items 14-25, wherein the connection elements are attached away from the edge of the suspended light-modifier, such that the light from the lighting device is not blocked by the connection elements.
27. The modular lighting device according to any of the preceding items, further comprising a shade for distributing, diffusing or refracting the light from the modular lighting device, said shade attached at a preselected distance below the reflector.
28. The modular lighting device according to item 27, wherein said shade is attached is attached to the lamp-fitting or to the reflector.
29. The modular lighting device according to item 28, wherein the shade is made from metal, such as brushed aluminum or polished aluminum, or made from glass, or clear plastic, or frosted glass, or opaque plastic, or a Fresnel lens, or a de-glaring prism.
30. A method for retro-fitting a modular lighting device in a lamp housing of an existing lamp installation which is countersunk in and/or suspended behind an opening in a building surface, the method comprising the steps of:
    dismantling the lamp housing from the lamp installation,
    providing the modular lighting device according to any of the preceding items,
    optionally creating an aperture in a top section of the lamp housing that is configured to match the lamp-fitting of the modular lighting device,
    securing the lamp-fitting to the top section of the lamp housing,
    installing a light source in the lamp-fitting,
    attaching the reflector of the modular lighting device to the lamp-fitting,
    installing the lamp housing with the modular lighting device in the opening of the building surface such that the reflector covers the opening and/or such that the lamp housing is obscured from view by the reflector.
31. A lamp device comprising
    a lamp housing comprising a top section having an aperture and a bottom section defining an opening,
    a lamp-fitting configured for receiving a light source and configured for attachment to the top section of the lamp housing through the aperture, and
    a reflector for reflecting and/or modifying light from the light source, the reflector comprising a narrow top section configured for attachment to said lamp-fitting, and a wider bottom section configured for covering the opening of the lamp housing.
32. The lamp device of item 31, configured for being flush mounted or countersunk into an opening of a ceiling or interior surface of a building such that the perimeter of the bottom section of the lamp housing abuts the opening of the a ceiling or interior surface.
33. The lamp device of any of preceding items 31-32, comprising any of the features of the modular lighting device of any of preceding items 1-29.
34. A shaded lighting device comprising:
    a reflector having a circumferential indentation or groove,
    a suspended shade for distributing, diffusing or refracting the light from the lighting device, and
    connection elements made from a resilient material and attached to the suspended shade, wherein the circumferential groove or indentation in the reflector is configured for receiving said connection elements for attaching the suspended shade to the reflector.
35. The shaded lighting device according to item 34, wherein the lighting device is configured for being integrated into a ceiling or interior surface of a building.
36. The shaded lighting device according to any of items 34 to 35, wherein the circumferential indentation or groove is a concave rounding or bulge on the reflector.
37. The shaded lighting device according to any of items 34 to 36, wherein the connecting elements have a bulge or dent configured for engaging with the circumferential indentation or groove in the reflector.
38. The shaded lighting device according to any of items 34 to 37, wherein the lighting device comprises at least 2, or at least 3, or at least 4 connection elements for attaching the suspended shade to the reflector.
39. The shaded lighting device according to any of items 34 to 38, wherein the suspended shade is made from metal, such as brushed aluminum or polished aluminum, or made from glass, or frosted glass, or clear plastic, or opaque plastic, or a Fresnel lens, or a de-glaring prism.
40. The shaded lighting device according to any of items 34 to 39, wherein the connection elements are attached away from the edge of the suspended shade, such that the light from the lighting device is not blocked by the connection elements.
41. A lighting device comprising:
    a lamp-fitting configured for receiving a light source, and
    a pendant suitable for being suspended from a ceiling, wherein said pendant comprises an acoustic element configured for absorbing energy from sound waves incident on the pendant in order to dampen noise or sound in the surroundings of the lighting device.

42. The lighting device according to item 41, wherein the acoustic element comprises a plurality of stacked rings or discs.

43. The lighting device according to any of items 41-42, wherein the acoustic element comprises a material suitable for absorbing sound energy.

44. The lighting device according to any of items 41-43, wherein the acoustic element comprises mineral wool.

45. The lighting device according to any of items 41-44, wherein the pendant predominantly resembles the shape of a globe.

46. The lighting device according to any of items 41-45, wherein the lighting device further comprises a reflector for reflecting and/or modifying light from the light source.

The invention claimed is:

1. A modular lighting device for retro-fitting to an existing lamp housing which is flush mounted or countersunk into an opening of a ceiling or interior surface of a building, the modular lighting device comprising:

a lamp-fitting configured for receiving a light source and configured for attachment to the existing lamp housing, and a reflector for reflecting and/or modifying light from the light source, the reflector comprising a narrow top section configured for attachment to said lamp-fitting, and a wider bottom section for covering said opening, such that the reflector is configured for covering different sized openings, wherein the reflector of said modular lighting device is configured for engagement with the lamp-fitting and further configured for axial adjustment of the position of the reflector relative to said lamp-fitting to accommodate different sized lamp housings, wherein the reflector is in the shape of a convex curve such that the bottom section of the reflector is substantially parallel with a building surface in which the device is configured for being installed, and/or the bottom section of the reflector comprises a rim at the perimeter thereof, wherein said rim extends back towards the top section of the reflector.

2. The modular lighting device according to claim 1, wherein the shape of the reflector is configured such that the part that connects to the lamp-fitting is recessed behind the finished ceiling surface or interior surface.

3. The modular lighting device according to claim 1, wherein the shape of the reflector is a convex curve and the shape is such that the reflector connects and/or spans the lamp-fitting and the ceiling.

4. The modular lighting device according to claim 1, wherein the perimeter of the bottom section of the reflector is configured for overlapping the existing lamp-housing in its connection to the ceiling or interior surface.

5. The modular lighting device according to claim 1, wherein a bottom part of the lamp-fitting and the top section of the reflector are configured for threaded engagement.

6. The modular lighting device according to claim 1, wherein at least part of the shape of the reflector is convex in the form of an exponential curve, or a hyperbola, or part of a parabola, or part of a circle.

7. The modular lighting device according to claim 1, configured such that the bottom section of the reflector is protruding less than 10 mm from the ceiling or interior surface.

8. The modular lighting device according to claim 1, further comprising an extension element configured for being attached between the top section of the reflector and a bottom section of the lamp-fitting, configured for creating extra distance between the lamp-fitting and the reflector such that the modular lighting device may be fitted to deeper or larger lamp housings.

9. The modular lighting device according to claim 1, further comprising a light-modifier for distributing, diffusing or refracting the light from the light-source housed in the lamp-fitting of the modular lighting device, said light-modifier attached mechanically, magnetically or otherwise to the reflector.

10. The modular lighting device according to claim 9, the light modifier further comprising:

a holding-ring which has the capacity to encapsulate a lens or diffuser, and said diffuser, made from a translucent or transparent resilient material which is held in place by the said holding-ring a diffusor, lens or transparent or translucent light modifying medium located within the holding ring which is secured between the holding ring and the recessed reflector wherein the light-modifier is attached to the recessed reflector.

11. The modular lighting device according to claim 1, further comprising an acoustic element for modifying the sound in proximity to the lighting device, said acoustic element attached mechanically, magnetically or otherwise to the reflector.

12. The modular lighting device according to claim 11, wherein the acoustic element is configured for dampening the sound in the environment by absorbing energy from the sound waves and/or by reflecting the sound waves incident on the acoustic element.

13. The modular lighting device according to claim 11, wherein the acoustic element extends along the entire circumference of the reflector.

14. The modular lighting device according claim 11, wherein the outer surface of the acoustic element resembles at least partially that of a torus.

15. The modular lighting device according to claim 11, wherein the outer surface of the acoustic element is cylindrical with straight walls.

16. A method for retro-fitting a modular lighting device in a lamp housing of an existing lamp installation which is countersunk in and/or suspended behind an opening in a building surface, the method comprising the steps of:

dismantling the lamp housing from the lamp installation, providing the modular lighting device according to claim 1, optionally creating an aperture in a top section of the lamp housing that is configured to match the lamp-fitting of the modular lighting device, securing the lamp-fitting to the top section of the lamp housing, installing a light source in the lamp-fitting, attaching the reflector of the modular lighting device to the lamp-fitting, and installing the lamp housing with the modular lighting device in the opening of the building surface such that the reflector covers the opening and/or such that the lamp housing is obscured from view by the reflector.

17. A lamp device comprising a lamp housing comprising a top section having an aperture and a bottom section defining an opening, a lamp-fitting configured for receiving a light source and configured for attachment to the top section of the lamp housing through the aperture, and a reflector for reflecting and/or modifying light from the light source, the reflector comprising a narrow top section configured for attachment to said lamp-fitting, and a wider bottom section configured for covering the opening of the lamp housing, such that the reflector is configured for covering different sized openings, wherein the reflector of said lamp device is configured for engagement with the lamp-fitting and further configured for axial adjustment of the position of the reflector relative to said lamp-fitting, and wherein the reflector is in the shape of a convex curve such that the bottom section of the reflector is substantially parallel with a building surface in which the device is configured for being installed, and/or the bottom section of the reflector comprises a rim at the perimeter thereof, wherein said rim extends back towards the top section of the reflector.

18. The lamp device of claim 17, configured for being flush mounted or countersunk into an opening of a ceiling or interior surface of a building such that the perimeter of the bottom section of the lamp housing abuts the opening of the a ceiling or interior surface.

19. The lamp device of claim 17, wherein the perimeter of the bottom section of the reflector is configured for overlapping the existing lamp-housing in its connection to the ceiling or interior surface.

* * * * *